US012453368B2

(12) United States Patent
Masri

(10) Patent No.: US 12,453,368 B2
(45) Date of Patent: Oct. 28, 2025

(54) HOOKAHS, HEATING UNITS, AND RELATED METHODS

(71) Applicant: Starbuzz Tobacco, Inc., Garden Grove, CA (US)

(72) Inventor: Rodney Masri, Statesboro, GA (US)

(73) Assignee: Starbuzz Tobacco, Inc., Garden Grove, CA (US)

( * ) Notice: Subject to any disclaimer, the term of this patent is extended or adjusted under 35 U.S.C. 154(b) by 1004 days.

(21) Appl. No.: 17/537,276

(22) Filed: Nov. 29, 2021

(65) Prior Publication Data

US 2022/0079218 A1 Mar. 17, 2022

Related U.S. Application Data

(62) Division of application No. 16/185,608, filed on Nov. 9, 2018, now Pat. No. 11,206,866.

(60) Provisional application No. 62/584,046, filed on Nov. 9, 2017.

(51) Int. Cl.
*A24F 1/30* (2006.01)
*F24H 3/08* (2022.01)

(52) U.S. Cl.
CPC ..... *A24F 1/30* (2013.01); *F24H 3/088* (2013.01)

(58) Field of Classification Search
CPC ..... A24F 1/30; A24F 40/40; A24F 40/46
See application file for complete search history.

(56) References Cited

U.S. PATENT DOCUMENTS

D150,357 S 7/1948 Herbster
D158,672 S 5/1950 Koch
D185,487 S 6/1959 Boyer
D383,178 S 9/1997 Breuil
D494,474 S 8/2004 Houk et al.
D520,180 S 5/2006 Chen
7,287,530 B1 10/2007 Stuart
D579,535 S 10/2008 Hsu
D617,941 S 6/2010 Bjorkholm
7,798,152 B1 9/2010 Tannous
7,827,995 B2 11/2010 Chaoui
D672,084 S 12/2012 Ducey
D677,427 S 3/2013 Ross
8,459,269 B2 6/2013 Zoumut
8,464,725 B2 6/2013 Badawi
8,490,630 B2 7/2013 Boutros et al.
(Continued)

FOREIGN PATENT DOCUMENTS

WO WO 2016/081920 A1 5/2016

OTHER PUBLICATIONS

Restriction Requirement on corresponding US application (U.S. Appl. No. 29/636,018) dated Feb. 26, 2019.
(Continued)

*Primary Examiner* — Michael H. Wilson
*Assistant Examiner* — Jennifer A Kessie
(74) *Attorney, Agent, or Firm* — Alumen IP Law PC

(57) ABSTRACT

A hookah device having a heating unit, a head for holding a cooking element, a pipe, and a base. The heating unit for use with the hookah device can be provided with optimally placed vents along a bottom wall, a sidewall, and a top wall to facilitate circulation of fresh air and heated air. An optional thermometer can be mounted to the housing for recording a temperature reading with a combustion chamber of the heating unit.

20 Claims, 13 Drawing Sheets

(56) References Cited

U.S. PATENT DOCUMENTS

| | | | | |
|---|---|---|---|---|
| 8,590,541 | B2 | 11/2013 | Mehio | |
| 8,757,170 | B2 | 6/2014 | Kaplani | |
| 8,763,799 | B2 | 7/2014 | Haidar | |
| 8,826,915 | B2 | 9/2014 | Mehio | |
| 9,107,456 | B2 | 8/2015 | Mehio | |
| 9,237,770 | B2 | 1/2016 | Bavar | |
| 9,247,772 | B2 | 2/2016 | Mehio | |
| D760,430 | S | 6/2016 | Hanna | |
| D764,652 | S | 8/2016 | Weiss et al. | |
| D802,836 | S | 11/2017 | Ghiotti et al. | |
| D804,093 | S | 11/2017 | Chen | |
| 9,833,018 | B2 | 12/2017 | Mehio | |
| 9,877,517 | B2 | 1/2018 | Liu | |
| D814,105 | S | 3/2018 | Eng et al. | |
| D818,567 | S | 5/2018 | Burnett et al. | |
| D825,101 | S | 8/2018 | Hoch et al. | |
| D861,977 | S | 10/2019 | Masri | |
| 2007/0056599 | A1 | 3/2007 | Zoumut | |
| 2010/0212679 | A1 | 8/2010 | Bishara | |
| 2011/0180080 | A1* | 7/2011 | Fares | A24F 1/30 131/184.1 |
| 2013/0330680 | A1* | 12/2013 | Bavar | A24F 1/30 432/225 |
| 2014/0326257 | A1 | 11/2014 | Jalloul et al. | |
| 2016/0143353 | A1* | 5/2016 | Bavar | A24F 5/10 131/194 |
| 2016/0249677 | A1 | 9/2016 | Bishara | |

OTHER PUBLICATIONS

Notice of Allowance on corresponding US application (U.S. Appl. No. 29/636,018) dated May 13, 2019.

Notice of Allowance on corresponding US application (U.S. Appl. No. 29/701,319) dated Feb. 20, 2020.

International Search Report and Written Opinion on corresponding PCT application (PCT/US2018/059999) from International Searching Authority (EPO) dated Mar. 22, 2019.

International Preliminary Report on Patentability on corresponding PCT application (PCT/US2018/059999) from International Searching Authority (EPO) dated May 22, 2020.

Starbuzz Nar, by Shisha Gear, dated Dec. 8, 2018, found online May 6, 2019, https://www.youtube.com/watch?v=m-PPbzviVRK.

* cited by examiner

HOOKAHS, HEATING UNITS, AND RELATED METHODS

CROSS-REFERENCE TO RELATED APPLICATION(S)

This is a divisional application of Ser. No. 16/185,608, filed Nov. 9, 2018, which is a regular utility of Provisional application Ser. No. 62/584,046, filed Nov. 9, 2017, the contents of each of which are expressly incorporated herein by reference as if set forth in full.

FIELD OF THE INVENTION

The present invention relates to a hookah and more particularly to a heating unit for applying heat to a combustible material to generate for vaporizing oil essences from a cooking element for inhalation and related methods.

BACKGROUND

Hookahs have become a popular tool for smoking tobacco. A typical hookah includes a head, a pipe, and a water bowl. The head includes a heating unit and a cooking chamber, the pipe includes a stem, and the bowl includes a reservoir and an inhaling tube. The head rests upon the pipe. In the head, the heating unit couples to the cooking chamber to provide heat from a heat source such as burning charcoal, coal, or some other kind of fuel. The heat generated by the heat source is directed into the cooking chamber where tobacco is deposited. The heat causes the tobacco to emit smoke, such as by vaporizing the oil essences from the tobacco, that can then be enjoyed by a user.

An opening in the cooking chamber connects to the stem of the pipe. The stem has a conduit that extends into a reservoir of liquid stored in the base. The base encloses a reservoir of liquid and an area above the reservoir that provides an air pocket. The smoking tube has an opening into the base that is above the surface level of the reservoir.

To smoke the combustible material, user inhales a mouthpiece connected the smoking tube. The inhalation through the tube draws air from the air pocket creating a partial vacuum in the base. The partial vacuum draws smoke from the cooking chamber into the stem and through the reservoir of liquid into the air pocket. As the user continues to inhale, the smoke is drawn through into the smoking tube where it is inhaled by the user.

To function properly, the combustible material or cooking element in the hookah must be heated to a proper temperature range. The proper temperature range causes the combustible material to generate smoke that has a desired flavor and is of a sufficient amount to smoke to maximize the enjoyment of the user. If too much heat is applied, the combustible material may burn in the cooking chamber. The burning of the combustible material may cause the material to lose the intended flavor, produce undesired gases, and/or produce fine ash that may be inhaled by the user and/or collect in various part of the hookah causing an unwanted mess and/or damage.

SUMMARY

An advance in the art is made by a heating unit for a hookah in accordance with various embodiments of the invention. An exemplary heating unit for a hookah in accordance with some embodiments of the invention can include a housing with multiple vents, ports, or channels formed through wall surfaces of the housing.

The vents on the various walls of a heating unit allow air flow to be directed into the internal chamber of the housing to control the burning of the fuel in the combustion chamber and then heated air to exit the internal chamber of the housing for use to heat a cooking element. In some examples, a vent cover can be included to control the vent openings on the various walls. The vent cover can act like louvers for controlling one or more vents incorporated with the housing.

The housing can have walls defining a combustion chamber, said walls can comprise a sidewall, a top side, and a bottom side. A vent can form through the sidewall of the housing from the exterior of the housing into the combustion chamber to allow fresh air flow from the exterior to flow into the combustion chamber. In exemplary embodiments, more than one air vent can be provided through the sidewall. For example, four spaced apart air vents can be provided through the sidewall. Other number of air vents are contemplated, such as fewer than or greater than four.

In some examples, the sidewall can comprise a first, upper, or lid sidewall attached to a second, lower, or base sidewall. The lid sidewall and the base sidewall together can form a sidewall of a housing of the present invention. The sidewall of the housing can have a seam where the lid sidewall attaches to the base sidewall. The one or more air vents can form through the base sidewall, which is also understood as the lower or second sidewall. The vents formed with the base sidewall can be located near a base wall or bottom wall of the base, which can have coal or charcoal placed thereon.

A thermal conduit can form through the bottom wall of the base, through the sidewall of the base, and form a flow path between the combustion chamber and an exterior of the housing. In an example, gas flow through a thermal conduit can exit the housing and be directed to the cooking chamber to heat the cooking element. In exemplary embodiments, more than one thermal conduit can be provided through the sidewall and the bottom wall of the base. For example, four spaced apart thermal conduits can be provided through the bottom wall and through the sidewall of the base. Each thermal conduit can be a through-hole or through path and can extend, along that single path, through the sidewall and through the base connected to the sidewall. In some examples, there can be fewer than four or greater than four thermal conduits.

A plurality of top vents can form through the top wall of the lid. In exemplary embodiments, four sets of top vents are provided. Each set of top vents can comprise two or more troughs or channels separated by lands or ribs. The two or more troughs or channels within a set of top vents can have different lengths.

In an example, a first sent of top vents can have a different number of troughs or channels than the number of troughs or channels of an adjacent second set of top vents. The different number of troughs or channels between adjacent sets of top vents on the top wall allows a vent cover with similarly equipped set of top vents to: (1) overlie the top vents on the top wall of the lid when the vent cover is at a first position over the top wall to allow substantial full opening of the channels of the top vents, (2) overlie the top vents on the top wall of the lid when the vent cover is at a second position over the top wall to partially close the channels of the top vents, or (3) overlie the top vents on the top wall of the lid when the vent cover is at a third position over the top wall to substantially close the channels of the top vents.

The vent cover can be moved relative to the top wall, such as by shifting or by rotation. The vent cover can be moved relative to the top wall by grasping a knob projecting from the vent cover.

A central opening can be provided through the top wall to function as a thermometer coupling. The top vents on the top wall of the lid can form in sections around the central opening. The central opening can be omitted when no thermometer is used or a removable cap can be provided at the central opening to allow options for receiving a thermometer. A vent cover can include a central opening that aligns with the central opening on the top wall.

The side air vents can provide fresh air flow into the combustion chamber. The thermal conduits can direct hot air from the combustion chamber out through the bottom wall and into a cooking chamber of a head of a hookah device having a cooking element, such as tobacco or medicinal herbs, located therein. The top vents on the lid can be regulated by opening or controlling air flow in and out through the top vents. The control of the top vents can be provided by using a vent cover, which can be moved, such as rotated, relative to the lid to control the openings of the top vents.

In accordance with some embodiments, an airflow groove or grooves may be defined within a bottom interior surface of the combustion chamber, such as on the bottom wall of the base. Coal or charcoal may be placed on the bottom wall in the combustion chamber having the airflow grooves, which can facilitate gas flow between the coal or charcoal and the bottom wall.

The sidewall of the lid and the sidewall of the base can engage using friction fit. The housing sidewall therefore can include a seam. The housing can be made from anodized aluminum. Two or more handles can be provided with the housing for handling the housing.

In accordance with some embodiments, the housing may be made up of a base and a lid. The base can have a bottom wall with a bottom interior surface that defines a bottom of the combustion chamber and the lid can have a sidewall that couples to the sidewall of the base to enclose the combustion chamber. The lid has a top wall with one or more top vents formed therethrough. In still other examples, only the base has a sidewall and the lid rests on the sidewall of the base, without any sidewall of its own.

In many of these embodiments, a vent may be defined through a sidewall of the base, such as along a path that is generally orthogonal to the vertical wall surface of the sidewall. Fresh air can be directed through the vent and into a combustion chamber. In accordance with a number of these embodiments, a thermal conduit may have an opening at an end edge of the sidewall with a path extending through the vertical length of the sidewall and out an opening on a bottom surface of the lid. Thus, heated gas or air in the combustion chamber can rise within the combustion chamber, directed through the thermal conduit formed through the sidewall of the base, and then out an opening at the bottom wall of the base. The heated gas can be directed through the one or more thermal conduits formed with the base when it contacts the wall surfaces of the housing and the geometry of the combustion chamber and the cooler surface of the housing versus the middle of the combustion chamber create a thermal cycling that directs the heated gas or air down through the thermal conduits and then out the base to be directed into a cooking chamber.

In accordance with several of these embodiments, a recess surface defined in the bottom surface of the base can be provided for contacting a head, a tray, or a part of a hookah for mounting the heating unit onto the hookah.

In accordance with some embodiments, a first handle may be connected to the lid and a second handle connected to the base. In accordance with many of these embodiments, the first and second handles may each include a shaft having a first end and a second end. The first end of the shaft may be configured to insert into a handle coupling in the housing and a grip sheath may surround the second end of the shaft.

A further aspect of the invention includes a hookah device comprising: a heating unit comprising a housing having a structure defining a combustion chamber, the housing comprising: a sidewall having a wall thickness and a wall height; a top wall; a bottom wall; at least one vent formed through the sidewall to expose the combustion chamber to fresh air flow from an exterior; said at least one vent formed through the wall thickness of the sidewall; at least one thermal conduit formed through bottom wall and though the wall height of the sidewall to provide a flow path for hot air to flow out the combustion chamber; at least one vent formed through the top wall of the housing; and an opening having a thermometer disposed, at least in part, therein such that the thermometer can measure a temperature reading of the combustion chamber.

An airflow groove can be defined within a bottom interior surface of the bottom wall.

The thermometer can have a round display fitted into the opening, and wherein the opening can have a round shape and be located on the top wall.

The hookah device can comprise a plurality of spaced apart ornamentations surrounding the opening.

The at least one vent can comprise two or more sets of top vents formed through the top wall with each set of top vents comprising at least two channels of different lengths.

The hookah device can comprising: a vent cover affixed to a top side of the top wall of the housing, said vent cover being movable relative to the top wall to control flow openings through the two or more sets of top vents.

The hookah device of claim 6, wherein the vent cover is rotatable about a projection formed around the opening.

The hookah device of claim 6, further comprise a knob protruding from the vent cover for use in moving the vent cover.

The housing can be formed from at least two housing components, which can comprise a base and a lid.

The base can comprise the bottom wall and the lid can comprise the top wall and wherein the sidewall can comprise a top sidewall of the lid and a bottom sidewall of the base.

The at least one vent can be defined through the bottom sidewall of the base.

The coal or charcoal can be located in the combustion chamber.

The hookah device can comprise a first handle connected to the lid and a second handle connected to the base.

Each of the first and second handles can comprise a shaft having a first end attached to the housing and a second end; and a grip sheath surrounding the second end of the shaft.

A still further aspect of the invention can include a heating unit for use with a hookah device comprising: a two part housing comprising a base and a lid; said base comprising a bottom wall and a base sidewall; said lid comprising a top wall and a lid sidewall; said base sidewall and said lid sidewall having a seam therebetween; a combustion chamber defined by the top wall, the bottom wall, the base sidewall, and the lid sidewall; two or more spaced apart fresh air vents formed through the base sidewall each at a radial position along a perimeter of the base sidewall; two or more spaced apart thermal conduits formed through the bottom wall of the base each at a radial position along the perimeter of the base sidewall; and said radial positions of the two or more spaced apart thermal conduits being different than said radial positions of said two or more spaced apart fresh air vents.

A vent cover having a surface contour can be placed on top of the top wall and rotatable relative to the top wall.

The top wall can have a dome shape interior surface contour.

The two or more spaced apart thermal conduits can be formed through the base sidewall and each having an opening at end edge of the base sidewall.

In an exemplary embodiment, a hookah includes a head, a pipe, and a base, which is also understood in the industry as a water jar or bowl. The head can be affixed to a top of the pipe and the head can comprise a structure defining a cooking chamber for containing a quantity of a cooking element, such as tobacco, herbal leaves or other materials to be vaporized by heat to extract oil essences therefrom.

A heat management accessory unit can be positioned superjacent the head and the cooking element. The heat management accessory unit can be structured to receive combustible materials to then heat intake air, which can then be routed by flow channels to heat the cooking element in the head to vaporize oil essences therefrom for inhalation. The heat management accessory unit may herein alternatively be referred to as a heating unit.

The generated heat from the heating unit can be applied to the cooking element, such as passing over, across, and/or through the cooking element, to vaporize oil essences from the cooking element, which can be changed out, replenished or replaced from time-to-time as needed. The cooking element can be placed into the cooking chamber of the pipe by lifting the heating unit to expose the opening to the cooking chamber, which can optionally contain a fine mesh for retaining the cooking element and preventing the cooking element from dislodging further down the pipe.

Heated air from the heating unit is circulated to the cooking element inside the cooking chamber to generate smoke, which then passes through a downstem located in the base under column of liquid, such as a water column, for cooling and filtering the smoke before the smoke is routed through a hose port, hose, and then mouthpiece attached to the house for inhalation by a user using the mouthpiece.

The pipe described herein can include a stem and a portion of the stem, call a downstem, located inside the base with the opening of the downstem located under a column of water or liquid.

The height of the water level above the downstem opening can be adjusted by adding water to the base to control the volume of water above the opening of the downstem for cooling and filtering the heated smoke discharging out the downstem. A hose port can be provided with the hookah and the opening to the hose port in fluid communication with the vapor chamber of the base above the liquid level so that cooled and filtered smoke percolating through the water column can be directed through the hose port.

In some examples, there can be more than one hose port in fluid communication with the vapor chamber, such as two, three, or four hose ports. The additional hose ports can be connected to additional hoses and mouthpieces so that more than one user can use the same hookah.

A hose can connect to the hose port and a mouthpiece can be attached to the other end of the hose for use by a user to inhale the cooled and filtered smoke.

The base can embody any number of shapes and can be made from blown glass, porcelain or other materials. The base has an internal space that encloses a reservoir of liquid and provides an area above the reservoir, i.e., the vapor chamber, to contain smoke or air exiting a downstem and percolating through the liquid. In accordance with the shown embodiment, the liquid in the reservoir is water. However, other types of liquids may be used in accordance with various other embodiments of the invention, such as wine, soda, beer, spirit, coffee, tea, etc.

To inhale smoke, the user can first prepare the hookah, if not already prepared, with a desired quantity of cooking element in the cooking chamber of the head. The user then adds fuel to the heating unit, which can be in the form of coal or charcoal, or other conventional fuel sources for use with hookahs.

After a short heat up time, the user can begin to inhale on the mouthpiece at an end of the hose to draw air from the vapor chamber creating a partial vacuum in the enclosed area. The partial vacuum causes air or smoke to be drawn into pipe from the cooking element through the reservoir of the base and into the vapor chamber. As the user continues to inhale from the mouthpiece at the end of the house, smoke in the vapor chamber is sucked through the hose port and hose and then inhaled by the user. To clear the base of smoke, base may include a purge valve that may be opened to release the partial vacuum and let air escape from within the base.

The hookah device described is exemplary only as hookah devices having other configurations in accordance with various other embodiments of the invention are possible and usable with heating units of the present invention. Thus, the heating units described herein are understood to be usable with any number of hookah devices that require a heat source for heating intake air to heat a cooking element and is not limited to the hookah device shown.

In accordance with some embodiments of the invention, a heating unit for a hookah device, or hookah for short, includes a heat sensor such as a thermometer to indicate the temperature of the heat being generated by the heating unit. A thermometer for measuring the amount of heat being generated by the heating unit can be provided or included. In other examples, the thermometer can be omitted or a different type of thermometer can be used, such as a thermocouple with a digital display. If the thermometer is omitted, the opening for receiving the thermometer can be sealed, the lid can be designed without any opening, or be provided with a removable enclosure or opening cap for allowing an optional use of a thermometer A heating unit in accordance with aspects of the present invention can have a housing. In an exemplary embodiment, the housing is substantially cylindrical in shape. However, the housing may embody any other volumetric shapes in accordance with various other embodiments of the invention. The housing can be made of anodized aluminum in the shown embodiment. However, the housing may be made of many other materials including, but not limited to, metals and/or ceramics that can withstand high operating temperatures in accordance with some other embodiments of the invention.

The housing described herein can include two portions: an upper portion, first portion, or lid and a lower portion, second portion, or base. The lid and the base can be coupled together. In an embodiment, the lid and the base can have friction fit at respective sidewalls along a seam. However, the lid and the base may be coupled using a snap fit, threads, straps or buckles, and/or by any other manner of coupling two objects together in accordance with various other embodiments of the invention. In other examples, the two sidewall sections of the base and the lid can be permanently attached, such as by welding, or by unitarily forming the sidewall. In this alternative embodiment, the upper wall or top wall of the lid can separate from the wall and can have a seam between the top wall and the sidewall.

The surfaces of the housing can include ornamentations. When incorporated, the ornamentations can include one or more base ornamentations, lid ornamentations, perimeter ornamentations, and central ornamentations in accordance with the shown embodiment. These ornamentations can resemble recessed or embossed surface features to disrupt the smooth surfaces of the housing. The ornamentations can align, can be spaced evenly, can have different geometric shapes, can resemble spaced apart dots or weld beads, or combinations thereof. These ornamentations may embody any shape, size, and/or configuration that do not interfere with functional components of the heating unit in accordance with various other embodiments. In some examples, the ornamentations can resemble fins to assist with heat transfer.

The lid ornamentations can align with the base ornamentations along the outer peripheral of the housing, such as along the sidewall of the base and the sidewall of the lid. The central ornamentations on the upper surfaces of the lid can resemble weld beads or half domes and can be provided along an upper outer diameter of the lid and along a central opening of the lid for receiving a thermometer. In other examples, the central opening can be omitted or filled with a wall surface of the lid, where no thermometer is used. In yet other examples, a removable cap can cover a central opening to allow for optional use with a thermometer, as further discussed below.

The housing can include side air vents that provide air, such as fresh outside air, to a combustion chamber inside the housing. In the shown embodiment, the side air vents can form through a sidewall of the base proximate a bottom side of the sidewall such that the air vents open into the combustion chamber inside the housing proximate an interior bottom or bottom wall of the base.

The air vents can be formed through the wall thickness of the sidewall so that the combustion chamber inside the housing is open to the atmosphere via the air vents. The sidewall has a height. Thus, the wall thickness can be understood to generally be orthogonal to the height of the sidewall. The air vents can be generally oblong or racetrack in shape but can embody different shapes, such as star shape, round shape, oval shape, or polygonal shape, provided sufficient air flow can pass through the air vents for a desired operation. Other vents or conduits can have similarly shaped openings. The air vents can be sized and shaped to provide adequate air flow.

As shown, four air vents can be evenly spaced about the circumference of the sidewall of the base, closer to the bottom of the sidewall than the top of the sidewall. However, the number of air vents can vary depending on the size and shape of the air vents. Thus, there can be fewer than four air vents, such as only one air vent, if an opening of an air vent is sufficiently large to enable adequate fresh air flow into the combustion chamber.

The air vents can align with some of the base ornamentations. In other examples, the side vents may be placed anywhere on the sidewall of the base and/or the sidewall of the lid as dictated by need and/or design choice in accordance with the various other embodiments of the invention. Still further, different sets of air vents with different opening sizes can be incorporated with the largest opening sizes located closer to the bottom of the base and the smaller opening sizes located higher up on the sidewall of the base.

The heating unit may incorporate additional vents aside from the side air vents at the sidewall of the base. In an example, top vents can be formed through the top wall of the lid, from a top surface to an interior surface of the lid to provide an airflow into and out of the combustion chamber inside the housing. The top vents may be used to provide air to the fuel and/or to dissipate heat in the combustion chamber.

In an example, four sets of top vents can be provided through the top wall. Each set of top vents can include multiple vents with different vent lengths. The plurality of vents of each set of top vents can be spaced along the outer perimeter and smaller or shorter as the vents are situated closer to the central opening of the top wall.

Each set of top vents can alternate between an elongated trough or channel and a land or structure, which can be considered a rib. A second set of top vents can be arranged so that the troughs are aligned with the ribs from the first set of top vents. Thus, for the four sets of top vents, two of the sets can each include four troughs or channels and the other two sets of top vents can include three troughs or channels. The two different set-type of top vents can alternate between four channels and three channels. In other examples, the set-type of top vents can include a five channel set, a four channel set, a three channel set, and/or a one channel set.

Each channel of a particular set of top vents can be curved or arcuate and can be similarly shaped as small sections of the outer contour of the lid. The land or structure between two adjacent sets of top vents can be curved and can resemble vanes extending from the central opening extending towards the outer perimeter of the lid. However, there may be any number of top vents that are aligned in any number of different manners as dictated by functionality and/or design of lid in accordance with various other embodiments. The lands or structures on the lid can resemble ribs located between a plurality of channels. In other examples, the channels can have other shapes.

A vent cover can be movably affixed to or rest on the lid. The vent cover can comprise a correspondingly shaped structure with correspondingly shaped vents as the top wall of the lid. This allows the openings or vents on the vent cover to align with the channels of the top vents of the lid.

The vent cover can be rotated or moved relative to the lid so that the ribs of the vent cover align over and cover the channels of the top vents of the top wall. By providing the vent cover with the ability to move or rotate relative to the top wall, this allows the vent cover to control the opening sizes of the channels of the top vents from substantially fully open to substantially fully closed and anything in between to control the flow of air in and out of the top vents. In other words, the vent cover can be used as louver to control the opening sizes of the various channels of the top vents.

The top cover can have solid or rib portions and cut-out or channel portions configured to allow the vent cover to cover a portion and/or an entirety of one or more of top vents of the top wall to change the amount of airflow into and/or out of the combustion chamber of the housing. The vent can be substantially circular and shaped to correspond or match the shape of a top surface of the lid with a central opening for accommodating a thermometer.

The central opening of the vent cover can align about a central projection defining the central opening of the top wall of the lid. As such, the vent cover may rotate about a center of the heating unit to change the amount of vents being covered or overlapped with the ribs on the vent cover to change the total vent openings through the lid.

To enable rotation of the vent cover, one or more knobs can protrude out of an upper surface of the cover to allow a user to grasp the knobs to rotate the vent cover. Although the movement can be rotational, other types of movements may be performed by the vent cover based upon functional and design components of a heating unit in accordance with various other embodiments of the invention. The one or more knobs may be coated with an insulating material to enable grasping without harming a user's hand.

A thermometer can be used with the housing by inserting a thermometer stem through a thermometer coupling, which can be the central opening formed through the top wall of the upper portion. Appropriate shoulder or lip can be provided to ensure proper seating of the thermometer inside the thermometer coupling. The thermometer can have a display end exposed though housing and a sensor end, such as the thermometer stem, that extends into the combustion chamber though the thermometer coupling. The display end of the thermometer seat within the thermometer coupling via threaded engagement, a friction fit or in a slight interference fit. Optionally, detents or snap fit can be utilized to secure the thermometer to the lid. The display can be digital, analog, or both.

In an embodiment, the thermometer has a circular display that is flushed with the top surface of lid, which may instead project upwardly or recessed within the opening. Some other embodiments may have a thermometer with a different configuration and/or a different type of thermometer that may be inserted into the thermometer coupling. As such, the housing in accordance with many other embodiments may have a thermometer coupling and thermometer positioned elsewhere such as, but not limited to, through the side wall of lid and/or base. In some examples, a removable cap can be provided at the central opening that requires removal before placement of the thermometer to couple to the thermometer coupling.

Two or more handles can be provided with the heating unit. In an example, the two handles can attach to the housing, one to the sidewall of the lid and the other handle to the sidewall of the base, substantially perpendicularly to the surface of the sidewalls. The handles may be used to manipulate the lid and/or the base to open and close a combustion chamber and/or to move the housing, such as to and/from the hookah device. Although the handles are shown as extending out of the sidewalls of the lid and the base, the number of handles, configuration, and placement of the handles may vary in accordance with various other embodiments based upon functionality and/or design choice.

Each handle can be provided with surface ornamentations and contours that are other than purely cylindrical for aesthetic appeal. As shown, spaced apart elongated indentations can be provided along the side surfaces of the two handles and projections or bumps can be provided at end surfaces of the two handles. Each handle can be made from a metallic material, such as aluminum, or from high temperature resistant plastic material, such as PEEK, surrounding a metallic core, as further discussed below.

The bottom wall of the base can include a coupling ring so that when the housing is seated onto a structure on a hookah during installation and use, the coupling ring can mate or couple to a corresponding structure or projection on the hookah for alignment purposes and/or for securement. The bottom wall of the base can be provided with at least one thermal conduit. A plurality of spaced apart thermal conduits can be provided at the bottom wall each with an opening at the bottom wall. Each of the one or more thermal conduits can be aligned so that its path extends through the sidewall of the base and terminates as an opening along a upper edge of the sidewall.

The coupling ring is defined by a recess on the bottom surface of bottom wall of the base and can be used to guide the placement of the housing onto or against a head located on a hookah. In some embodiments, the coupling ring may have an attachment mechanism such as, but not limited to, threading, a cam, bores, and/or pins that are used to affix the heating unit in place in a proper orientation with respect to the head of the hookah device.

The plurality of spaced apart thermal conduits on the bottom wall are openings or channels defined through the bottom wall of the housing and through the sidewall of the base that are sized, shaped, and positioned to direct heat from a combustion chamber inside the housing through the thermal conduits at the sidewall and then out the base and into the cooking chamber of the head located below the heating unit to heat the cooking element, such as tobacco or floral essences.

In the shown embodiment, four thermal conduits are incorporated proximate the perimeter edge of the bottom wall of the base so as to align with the sidewall of the base. The same thermal conduit therefore has two openings, one at the bottom wall of the base and one at an end edge of the sidewall. The thermal conduits can be evenly spaced apart about the bottom wall and therefore also about the sidewall. Furthermore, the thermal conduits are located on the bottom wall such that they are not aligned with side air vents on the sidewall of the base so that fresh air passing through the side air vents are not immediately mixed with flow through the thermal conduits, which have hot gas coming from the combustion chamber inside the housing and then directed down through the thermal conduits and into the cooking chamber inside the head.

The offset, non-aligned configurations of the thermal conduits and the air vents at the sidewall allow for thermal mixing of hot and cold gas streams through convection to enhance the air to fuel ratio in the combustion chamber for proper heat generation. For example, fresh air can first enter through the air vents to be used for burning the fuel in the combustion chamber. The heated air is then directed through the thermal conduits and out the housing for heating a cooking element, such as tobacco or floral essences. Through differential pressure, outside air can also enter through the top vents of the upper or first portion, or through the vent openings of the vent covers, or both.

In some examples, the housing may have a different number of openings or vents that function as thermal conduits between the combustion chamber and the cooking chamber and can be in other than as shown locations as dictated by functionality and/or design choice in accordance with various other embodiments of the invention. For example, the thermal conduits can be located radially inwardly of the sidewall such that the paths of the thermal conduits are formed through the bottom wall of the base only, not through the sidewall. In yet other examples, there can be a combination of different thermal conduits, those that are formed through the bottom wall only and those that are formed through both the bottom wall of the base and through the sidewall of the base.

A combustion chamber within the housing can be sized and shaped to receive a fuel source to be placed within the combustion chamber and ignited to cause the fuel to combust and generate heat. Fuel may be wood, charcoal, coal, or any other conventional fuel sources for use with a hookah. In the shown embodiment, the fuel is placed on a bottom surface of the combustion chamber. In accordance with some other embodiments, the fuel may be placed on a raised platform to provide a gap between the bottom surface and the fuel for fuel/air mixing. In accordance with a few embodiments, the fuel may be placed within a defined recess and/or compartment in the combustion chamber. Optionally, the fuel may be placed directly on the bottom surface of the combustion chamber and channels are provided for air flow.

Handles can be provided comprising a shaft or rod and a gripping sheath. Each shaft can have a first end that is structured for insertion into a handle coupling or bore formed with the base and the lid. The two shafts are configured to fit into the two handle bores in the housing in a friction or size-on-size fit to affix to the housing. Optionally, the shafts can be threaded into threaded bores of the housing.

Gripping sheaths can be placed over the opposite ends of the two shafts to form the handles. Each gripping sheath can be made of a material that aids in the gripping of the sheath, or provided with means to facilitate gripping such as surface features or projections, and encloses at least a portion of a second end of a shaft. The sheaths can be made from the same material as the housing or from a different material, such as from a silicone material or a high temperature resistant plastic, such as PEEK.

Furthermore, thermal conduits can have openings at the end edge of the sidewall of the base and extend through the vertical height of the sidewall of the base to terminate with openings at the exterior bottom surface of the bottom wall of the base. The openings of the thermal conduits at the end edge of the sidewall are recessed from the exterior of the sidewall of the lid. Further, the top wall of the lid has a dome shape interior surface contour. This configuration allows the end edge of the sidewall of the base to be exposed within the combustion chamber or not covered by the lid. Thus, hot air or gas that rises to the dome shape interior surface contour can be directed along the curvature of the surface to then enter through the openings of the thermal conduits at the end edge of the sidewall to then discharge out the openings at the bottom wall of the base to flow into the cooking chamber of the hookah.

The fresh air vents through the sidewall located near the bottom wall of the base can have openings at the exterior surface of the sidewall and at the interior surface of the sidewall, along a path that is generally orthogonal to the height of the sidewall. The fresh air vents and the thermal conduits do not have paths that connect. This allows fresh air to be directed through the air vents for mixing with the fuel located inside the combustion chamber and then the heated air rises to the top dome shape interior surface contour of the lid to then be directed down through the thermal conduits at the end edge of the sidewall and then out the openings at the bottom wall. Where thermal conduits are incorporated through the bottom wall only but not through the sidewall, heated air can be directed down towards the bottom wall by the top dome shape interior surface contour of the lid and then through the openings at the bottom wall.

A sensor portion of the thermometer, such as the thermometer stem, can extend from the display into the housing for placement into the combustion chamber for sensing temperature within the combustion chamber. This allows the thermometer to measure the temperature inside the combustion chamber and present the measured temperature to a user at the display. The display can provide an analog reading of the temperature or a digital reading of the temperature inside the combustion chamber.

Mated collars of the lid and the base can couple together. The mated collars can be used to align the lid and the base and to secure the two when these two components are friction fit together. However, other couplings devices may be used in addition to or in lieu of the mated collars. Examples of coupling devices include, but are not limited to, mated pegs and bores, mated threads, cams, latches, buckles, and hinges in accordance with various other embodiments of the invention.

Handle couplings comprising bores defined in the outer sidewalls of the lid and the base respectively can be provided for receiving first ends the two shafts. The shafts of the handles can friction fit into the handle couplings in the shown embodiment. The two shafts can each incorporate a reduced tip at the respective first ends for forming shoulders on the two shafts to limit the amount of insertion into the handle coupling bores. In accordance with some other embodiments, the handles and handle couplings may have threads for threaded engagement to securely couple the handles to the housing. In accordance with various other embodiments, any other type of coupling mechanism may be used to secure the handles into the handle couplings.

The ventilation grooves can be trenches defined in the bottom interior surface of the bottom wall that allow air to flow under the fuel in the combustion chamber to facilitate combustion of the fuel, such as coal or charcoal. In the shown embodiment, the ventilation grooves can be concentrically defined trenches in the bottom interior surface of the bottom wall. However, the bottom interior surface may have any number of trenches that are in any configuration, including randomly placed crevices or trenches, in accordance with various other embodiments. Furthermore, ventilation at the bottom wall of the combustion chamber may be provided in other manners in accordance with some other embodiments, including, but not limited to, a raised platform with a perforated surface, a grill placed over the bottom interior surface, and a jagged surface.

A thermometer coupling can be an opening through a wall of the housing that has a defined recess proximate an outer surface configured to hold a top end of a thermometer while letting a sensor end of the thermometer to extend into the combustion chamber. In the shown embodiment, thermometer coupling is on a top surface of lid substantially in the center of the surface and is configured to receive a thermometer having a round head that includes a display. However, heating units in accordance with some other embodiments may have thermometer coupling placed in other areas of lid and/or base and may be configured to receive different types of thermometers.

Methods of making and methods of using the hookah device and components thereof are within the scope of the present invention.

BRIEF DESCRIPTION OF THE FIGURES

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of a hookah and components thereof provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
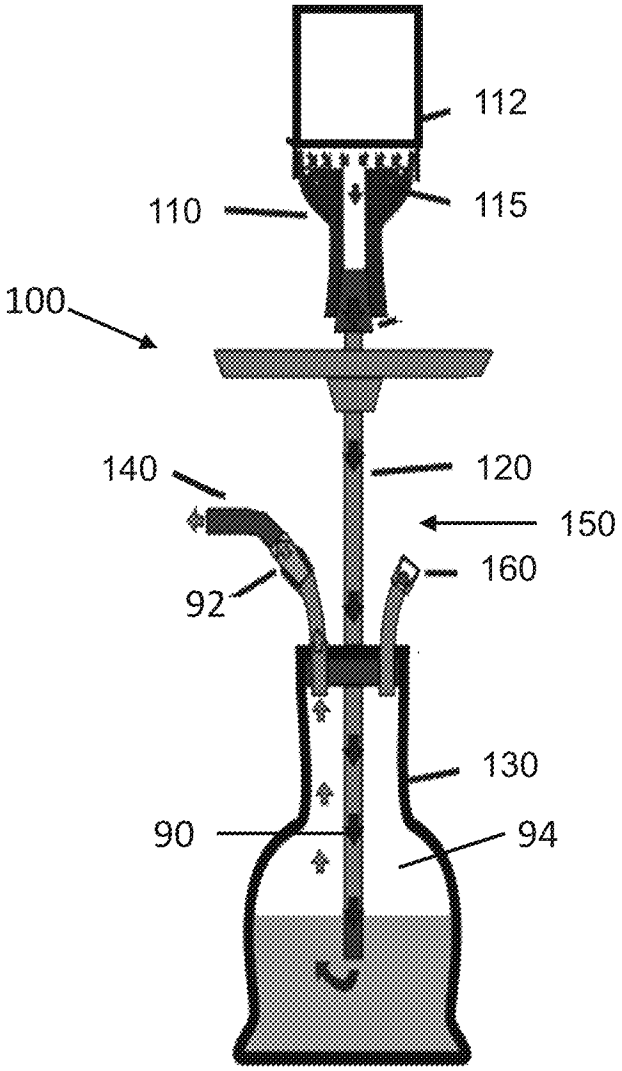
FIG. 1 is a side view of a hookah with a heating unit in accordance with an embodiment of the invention.

A hookah device or hookah with its many components are described. Also described is a heating unit for a hookah in accordance with some embodiments of the invention. The heating unit provides heat to a cooking element in the hookah to cook or heat the cooking element, which can be tobacco, herbs, floral essences, etc. In accordance with many embodiments of the invention, the heating unit can include a thermometer that indicates a temperature in a combustion chamber to allow a user to make adjustments to the body of the heating unit, such as to adjust vents for air flow or add more fuel, to apply a desired amount of heat to the cooking element to cook or heat the combustible material. An exemplary schematic view of a hookah 100 including a heating unit in accordance with an embodiment of the invention is shown in FIG. 1.

As shown, a hookah 100 includes a head 110, a pipe 150, and a base 130, which is also understood in the industry as a water jar or bowl. The head 110 is affixed to a top of the pipe 150 and the head comprising a structure defining a cooking chamber for containing a quantity of a cooking element 115, such as tobacco, herbal leaves or other materials to be vaporized by heat to extract oil essences therefrom.

A heat management accessory unit 112 is positioned superjacent the head 110 and the cooking element 115. The heat management accessory unit 112 is structured to receive combustible materials to then heat intake air, which is then routed by flow channels to heat the cooking element 115 in the head to vaporize oil essences therefrom for inhalation. The heat management accessory unit 112 may herein alternatively be referred to as a heating unit 112.

The generated heat from the heating unit 112 is applied to the cooking element 115, such as passing over, across, and/or through the cooking element 115, to vaporize oil essences from the cooking element, which can be changed out, replenished or replaced from time-to-time as needed. The cooking element 115 can be placed into the cooking chamber of the pipe 150 by lifting the heating unit 112 to expose the opening to the cooking chamber, which can optionally contain a fine mesh for retaining the cooking element and preventing the cooking element from dislodging further down the pipe 150. Heated air from the heating unit 112 is circulated to the cooking element inside the cooking chamber to generate smoke, which then passes through a downstem 90 located in the base 130 under column of liquid, such as a water column, for cooling and filtering the smoke before the smoke is routed through a hose port, hose, and then mouthpiece attached to the house for inhalation by a user using the mouthpiece.

With further reference to FIG. 1, the pipe 150 includes a stem 120 and a portion of the stem, call a downstem 90, located inside the base 130 with the opening of the downstem 90 located under a column of water or liquid. The height of the water level above the downstem opening can be adjusted by adding water to the base 130 to control the volume of water above the opening of the downstem for cooling and filtering the heated smoke discharging out the downstem. A hose port 92 is provided with the hookah and the opening to the hose port 92 is in fluid communication with the vapor chamber 94 of the base 130 above the liquid level so that cooled and filtered smoke percolating through the water column can be directed through the hose port 92.

In some examples, there can be more than one hose port in fluid communication with the vapor chamber 94, such as two, three, or four hose ports. The additional hose ports can be connected to additional hoses and mouthpieces so that more than one user can use the same hookah. A hose 140 can connect to the hose port 92 and a mouthpiece can be attached to the other end of the hose 140 for use by a user to inhale the cooled and filtered smoke.

The base 130 can embody any number of shapes and can be made from blown glass, porcelain or other materials. The base 130 has an internal space that encloses a reservoir of liquid and provides an area above the reservoir, i.e., the vapor chamber 94, to contain smoke or air exiting a downstem and percolating through the liquid. In accordance with the shown embodiment, the liquid in the reservoir is water. However, other types of liquids may be used in accordance with various other embodiments of the invention, such as wine, soda, beer, etc.

To inhale smoke, the user can first prepare the hookah, if not already prepared, with a desired quantity of cooking element in the cooking chamber of the head 110. The user then adds fuel to the heating unit 112, which can be in the form of coal or charcoal, or other conventional fuel sources for use with hookahs. After a short heat up time, the user can begin to inhale on the mouthpiece at an end of the hose 140 to draw air from the vapor chamber 94 creating a partial vacuum in the enclosed area. The partial vacuum causes air or smoke to be drawn into pipe 150 from the cooking element 115 through the reservoir of the base 130 and into the vapor chamber 94. As the user continues to inhale from the mouthpiece at the end of the house 140, smoke in the vapor chamber 94 is sucked through the hose port 92 and hose 140 and then inhaled by the user. To clear the base 130 of smoke, base 130 may include a purge valve 160 that may be opened to release the partial vacuum and let air escape from within the base 130.

The hookah device 100 described with reference to FIG. 1 is exemplary only as hookah devices having other configurations in accordance with various other embodiments of the invention are possible and usable with heating units 112 of the present invention. Thus, the heating units 112 described herein are understood to be usable with any number of hookah devices that require a heat source for heating intake air to heat a cooking element.

In accordance with some embodiments of the invention, a heating unit for a hookah device, or hookah for short, includes a heat sensor such as a thermometer to indicate the temperature of the heat being generated by the heating unit. FIGS. 2-13 illustrate a heating unit in accordance with an embodiment of the invention that provides a thermometer for measuring the amount of heat being generated by the heating unit. In other examples, the thermometer can be omitted or a different type of thermometer can be used, such as a thermocouple with a digital display.

Figure 2:
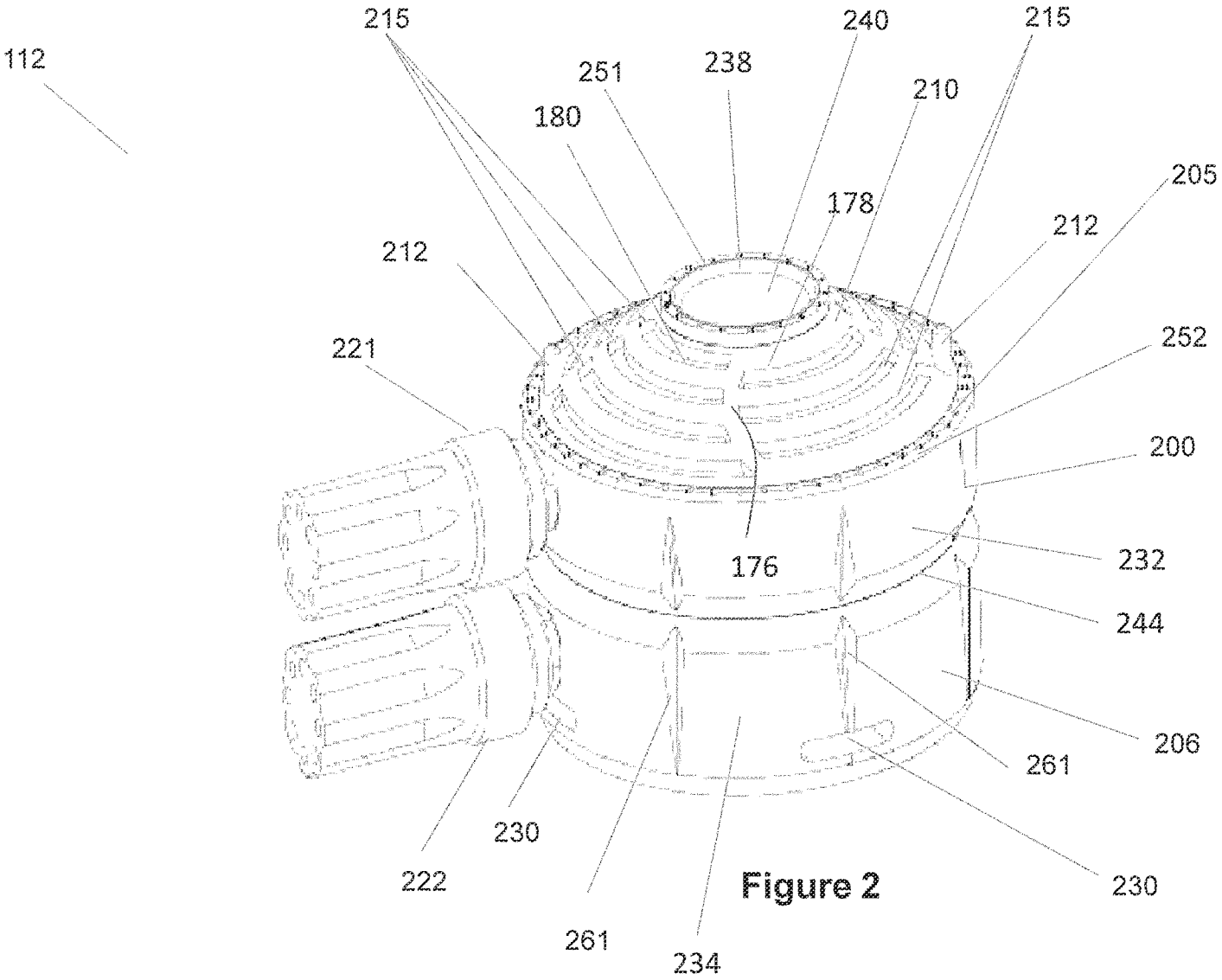
FIG. 2 is a top side perspective view from a first side of a heating unit for a hookah from a first side in accordance with an embodiment of the invention.
Figure 3:
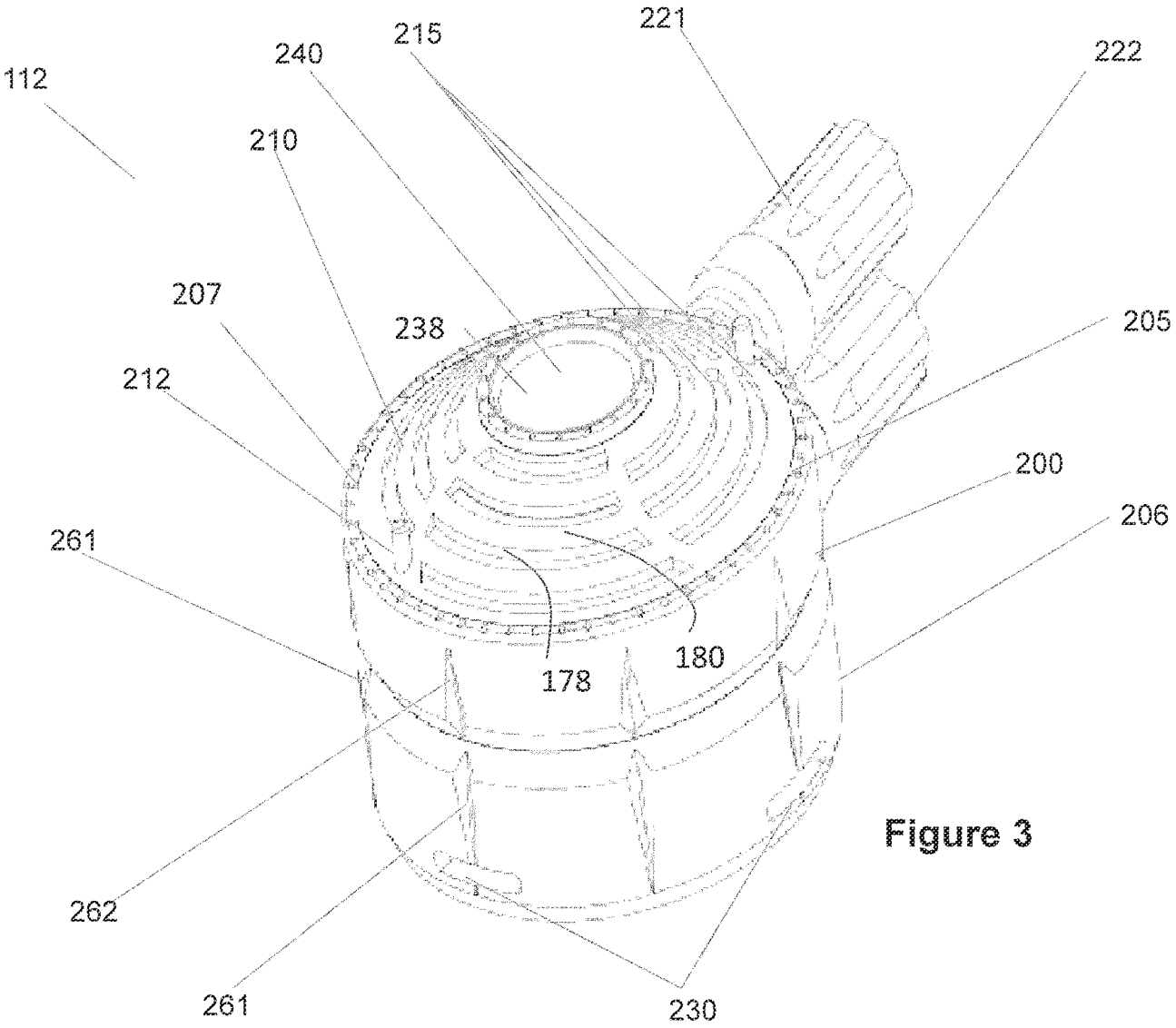
FIG. 3 is a top side perspective view of the heating unit for a hookah from a second side in accordance with the embodiment shown in FIG. 2.

Referring now to FIGS. 2 and 3, a heating unit 112 in accordance with aspects of the present invention is shown with a housing 200. In the shown embodiment, the housing 200 is substantially cylindrical in shape. However, the housing 200 may embody any other volumetric shapes in accordance with various other embodiments of the invention. The housing 200 can be made of anodized aluminum in the shown embodiment. However, the housing 200 may be made of many other materials including, but not limited to, metals and/or ceramics that can withstand high operating temperatures in accordance with some other embodiments of the invention.

As shown, the housing 200 includes two portions: an upper portion, first portion, or lid 205 and a lower portion, second portion, or base 206. The lid 205 and the base 206 can be coupled together. In the shown embodiment, lid 205 and base 206 are friction fit at respective sidewalls along a seam 244. However, lid 205 and base 206 may be coupled using a snap fit, threads, straps or buckles, and/or by any other manner of coupling two objects together in accordance with various other embodiments of the invention. In other examples, the two sidewall sections of the base 206 and the lid 205 can be permanently attached, such as by welding, or by unitarily forming the sidewall. In this alternative embodiment, the upper wall or top wall 207 (FIG. 3) of the lid can separate from the wall and can have a seam between the top wall and the sidewall.

The surfaces of the housing 200 can include ornamentations. When incorporated, the ornamentations can include one or more base ornamentations 261, lid ornamentations 262, perimeter ornamentations 252, and central ornamentations 251 in accordance with the shown embodiment. These ornamentations can resemble recessed or embossed surface features to disrupt the smooth surfaces of the housing 200. The ornamentations can align, can be spaced evenly, can have different geometric shapes, can resemble spaced apart dots or weld beads, or combinations thereof. These ornamentations may embody any shape, size, and/or configuration that do not interfere with functional components of the heating unit in accordance with various other embodiments. In some examples, the ornamentations can resemble fins to assist with heat transfer.

As shown, the lid ornamentations 262 align with the base ornamentations 261 along the outer peripheral of the housing 200, such as along the sidewall 234 of the base and the sidewall 232 of the lid. The central ornamentations 251 on the upper surfaces of the lid 205 can resemble weld beads or half domes and can be provided along an upper outer diameter of the lid and along a central opening 238 of the lid for receiving a thermometer 240. In other examples, the central opening 238 can be omitted or filled with a wall surface of the lid, where no thermometer is used. In yet other examples, a removable cap can cover a central opening 238 to allow for optional use with a thermometer, as further discussed below.

Housing 200 includes side air vents 230 that provide air, such as fresh outside air, to a combustion chamber inside the housing 200. In the shown embodiment, side air vents 230 are defined through a sidewall 234 of the base 206 proximate a bottom side of the sidewall such that the air vents open into the combustion chamber inside the housing proximate an interior bottom or bottom wall of the base 206. The air vents 230 are formed through the wall thickness of the sidewall 234 so that the combustion chamber inside the housing is open to the atmosphere via the air vents 230. The sidewall also has a height. Thus, the wall thickness is understood to generally be orthogonal to the height of the sidewall. The air vents shown are generally oblong or racetrack in shape but can embody different shapes, such as star shape, round shape, oval shape, or polygonal shape, provided sufficient air flow can pass through the air vents for a desired operation. Other vents or conduits can have similarly shaped openings.

As shown, four air vents 230 are evenly spaced about the circumference of the sidewall 234 of the base 206, closer to the bottom of the sidewall 234 than the top of the sidewall 234. However, the number of air vents 230 can vary depending on the size and shape of the air vents. Thus, there can be fewer than four air vents, such as only one air vent, if an opening of an air vent is sufficiently large to enable adequate fresh air flow into the combustion chamber. The air vents 230 can align with some of the base ornamentations 261. In other examples, the side vents 230 may be placed anywhere on the sidewall 234 of base 206 and/or sidewall 232 of the lid 205 as dictated by need and/or design choice in accordance with the various other embodiments of the invention. Still further, different sets of air vents 230 with different opening sizes can be incorporated with the largest opening sizes located closer to the bottom of the base and the smaller opening sizes located higher up on the sidewall of the base. Exemplary side air vents can each have an oblong opening of about 16 mm to about 22 mm wide and about 2.3 mm to about 5 mm tall, and wherein the two ends are rounded.

The heating unit 112 may incorporate additional vents aside from the side air vents 230 at the sidewall of the base. In an example, top vents 215 are formed through the top wall 207 of the lid 205, from a top surface to an interior surface of the lid 205 to provide an airflow into and out of the combustion chamber inside the housing 200. The top vents 215 may be used to provide air to the fuel and/or to dissipate heat in the combustion chamber. In the shown embodiment, four sets of top vents 215 are provided through the top wall 207. Each set of top vents 215 can include multiple vents with different vent lengths. The plurality of vents of each set of top vents 215 can be spaced along the outer perimeter and smaller or shorter as the vents are situated closer to the central opening 238 of the top wall 207.

As shown, each set of top vents can alternate between an elongated trough or channel 178 and a land or structure 180, which can be considered a rib. As shown, a second set of top vents can be arranged so that the troughs 178 are aligned with the ribs 180 from the first set of top vents. Thus, for the four sets of top vents 215, two of the sets can each include four troughs or channels 178 and the other two sets of top vents 215 can include three troughs or channels. The two different set-type of top vents can alternate between four channels 178 and three channels 178. In other examples, the set-type of top vents can include a five channel set, a four channel set, a three channel set, and/or a one channel set.

Each channel 178 of a particular set of top vents can be curved or arcuate and can be similarly shaped as small sections of the outer contour of the lid. The land or structure 176 between two adjacent sets of top vents 215 can be curved and can resemble vanes extending from the central opening 238 extending towards the outer perimeter of the lid. However, there may be any number of top vents 215 that are aligned in any number of different manners as dictated by functionality and/or design of lid 205 in accordance with various other embodiments. The lands or structures 176, 180 on the lid can resemble ribs located between a plurality of channels 178. In other examples, the channels 178 can have other shapes.

A vent cover 210 (FIG. 11) can be movably affixed to or rest on the lid 205. The vent cover 210 can comprise a correspondingly shaped structure with correspondingly shaped vents as the top wall 207 of the lid 205. This allows the openings or vents on the vent cover 210 to align with the channels of the top vents 215 of the lid. The vent cover 210 can then be rotated or moved relative to the lid so that the ribs of the vent cover 210 align over and cover the channels 178 of the top vents of the top wall 207. By providing the vent cover with the ability to move or rotate relative to the top wall 207, this allows the vent cover 210 to control the opening sizes of the channels 178 of the top vents 215 from substantially fully open to substantially fully closed and anything in between to control the flow of air in and out of the top vents 215. In other words, the vent cover 210 can be used as louver to control the opening sizes of the various channels of the top vents 215.

Figure 11:
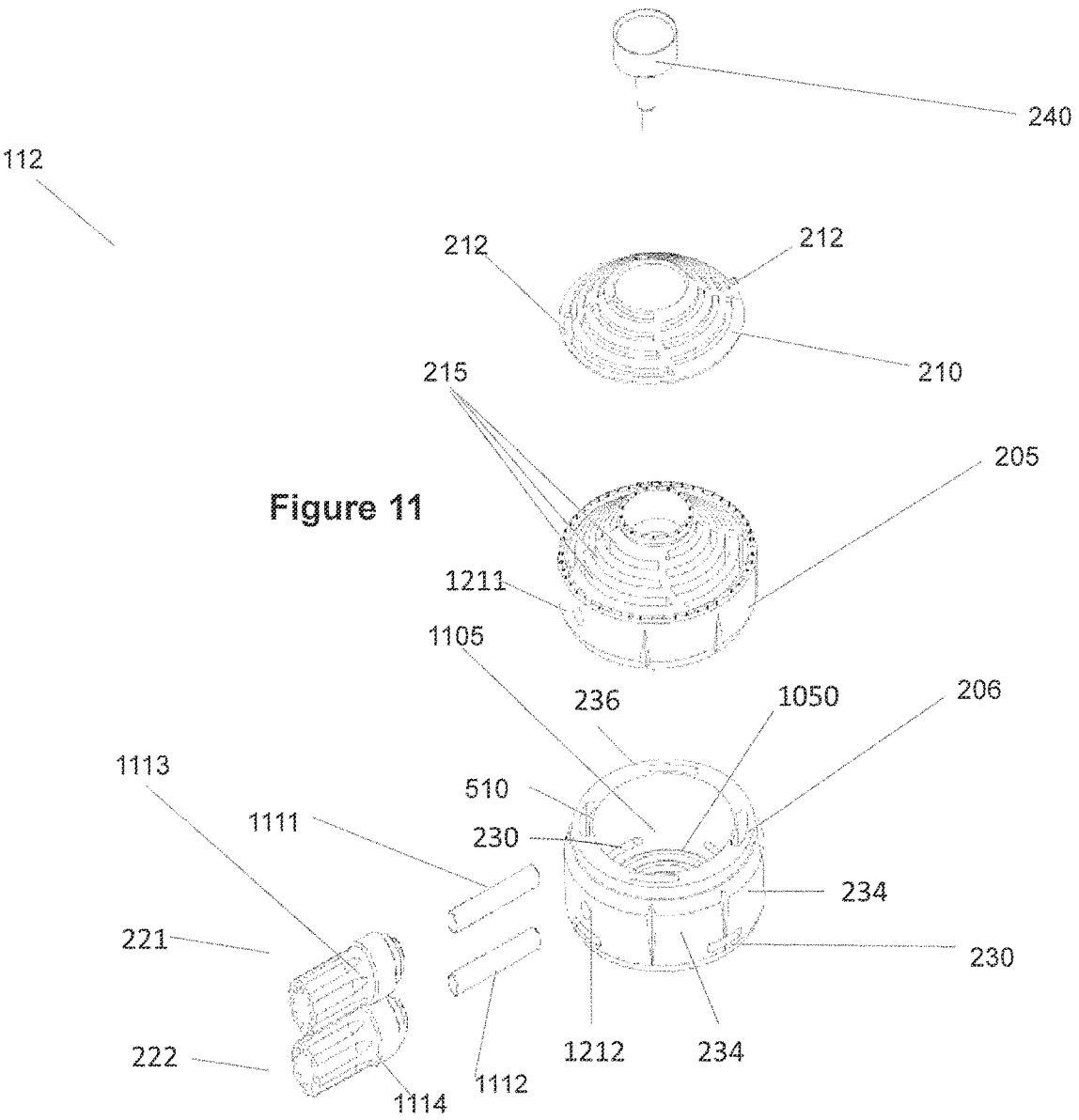
FIG. 11 is an exploded view of components of the heating unit for a hookah in accordance with the embodiment shown in FIG. 2.

As shown with reference to FIG. 11, the top cover 210 has solid or rib portions and cut-out or channel portions configured to allow the vent cover 210 to cover a portion and/or an entirety of one or more of top vents 215 of the top wall 207 to change the amount of airflow into and/or out of the combustion chamber of the housing 200. In the shown embodiment, the vent cover 210 is substantially circular and shaped to correspond or match the shape of a top surface of the lid 205 with a central opening for accommodating a thermometer. The central opening of the vent cover 210 can align about a central projection 248 (FIG. 7) defining the central opening 238 of the top wall 207 of the lid 205. As such, the vent cover 210 may rotate about a center of the heating unit 112 to change the amount of vents 215 being covered or overlapped with the ribs on the vent cover to change the total vent openings through the lid.

To enable rotation of the vent cover 210, one or more knobs 212 can protrude out of an upper surface of the cover 210 to allow a user to grasp the knobs to rotate the vent cover 210. Although the movement in the shown embodiment is described as rotational, other types of movements may be performed by the vent cover 210 based upon functional and design components of a heating unit in accordance with various other embodiments of the invention. The one or more knobs 212 may be coated with an insulating material to enable grasping without harming a user's hand.

A thermometer 240 can be used with the housing 200 by inserting a thermometer stem through a thermometer coupling, which can be the central opening 238 formed through the top wall 207 of the upper portion 205. Appropriate shoulder or lip can be provided to ensure proper seating of the thermometer inside the thermometer coupling. The thermometer 240 has a display end exposed though housing 200 and a sensor end, such as the thermometer stem, that extends into the combustion chamber though the thermometer coupling. The display end of the thermometer 240 seat within the thermometer coupling via threaded engagement, a friction fit or in a slight interference fit. Optionally, detents or snap fit can be utilized to secure the thermometer to the lid.

In the shown embodiment, the thermometer 204 has a circular display that is flushed with the top surface of lid 205, which may instead project upwardly or recessed within the opening. Some other embodiments may have a thermometer with a different configuration and/or a different type of thermometer that may be inserted into the thermometer coupling. As such, housing 200 in accordance with many other embodiments may have a thermometer coupling and thermometer positioned elsewhere such as, but not limited to, through the side wall of lid 205 and/or base 206. In some examples, a removable cap is provided at the central opening 238 that requires removal before placement of the thermometer to couple to the thermometer coupling.

Two or more handles 221, 222 can be provided with the heating unit 112. In an example, the two handles 221, 222 are attached to the housing, one to the sidewall 232 of the lid 205 and the other handle to the sidewall 234 of the base 206, substantially perpendicularly to the surface of the sidewalls. The handles 221 and 222 may be used to manipulate the lid 205 and/or the base 206 to open and close a combustion chamber and/or to move the housing 200, such as to and/from the hookah device. Although the handles 221 and 222 are shown as extending out of the sidewalls 232, 234 of the lid 205 and the base 206, the number of handles, configuration, and placement of the handles may vary in accordance with various other embodiments based upon functionality and/or design choice.

Each handle 221, 222 can be provided with surface ornamentations and contours that are other than purely cylindrical for aesthetic appeal. As shown, spaced apart elongated indentations can be provided along the side surfaces of the two handles and projections or bumps can be provided at end surfaces of the two handles. Each handle 221, 222 can be made from a metallic material, such as aluminum, or from high temperature resistant plastic material, such as PEEK, surrounding a metallic core, as further discussed below.

Figure 4:
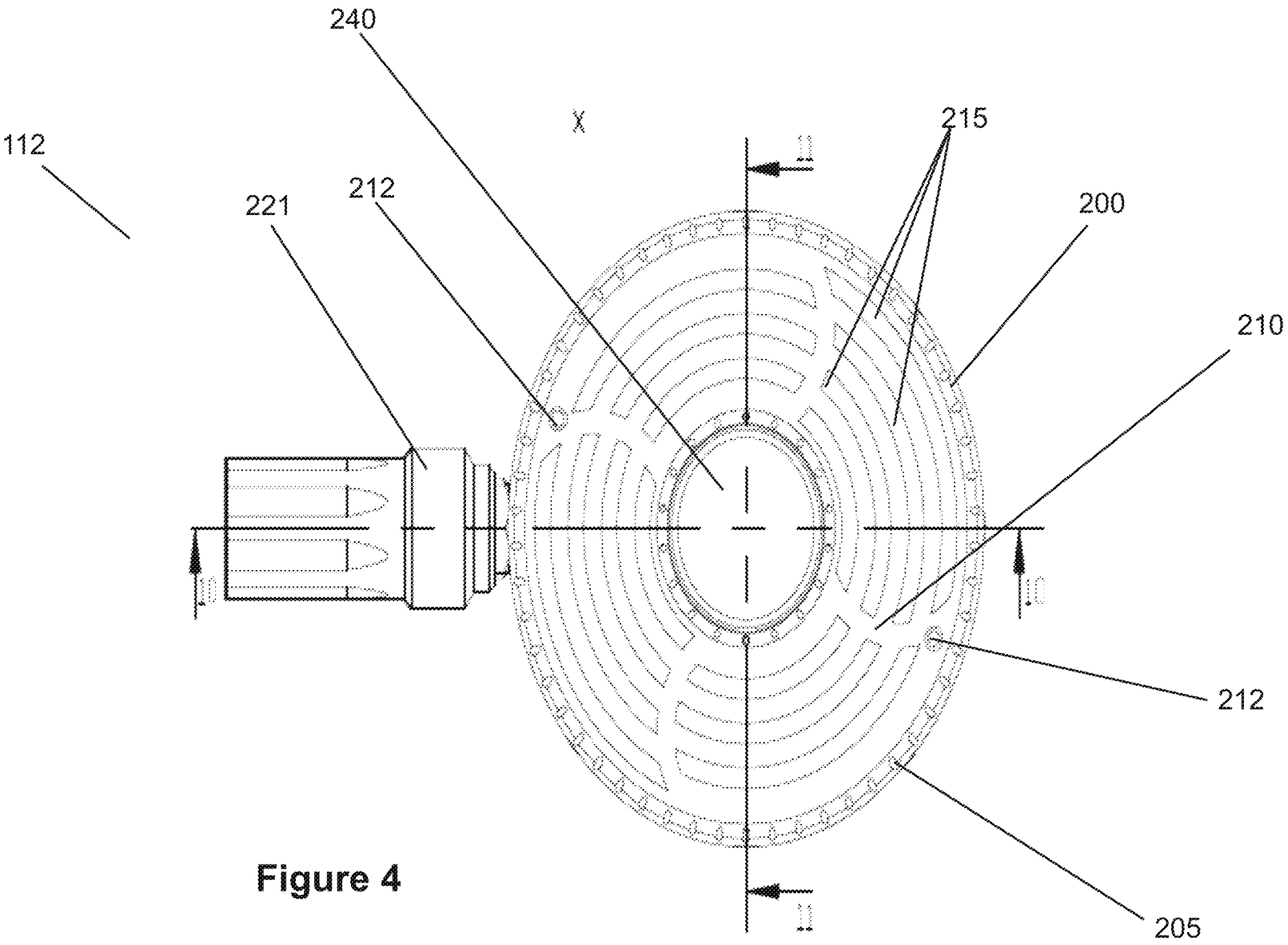
FIG. 4 is a top view of the heating unit in accordance with an embodiment shown in FIG. 2.
Figure 5:
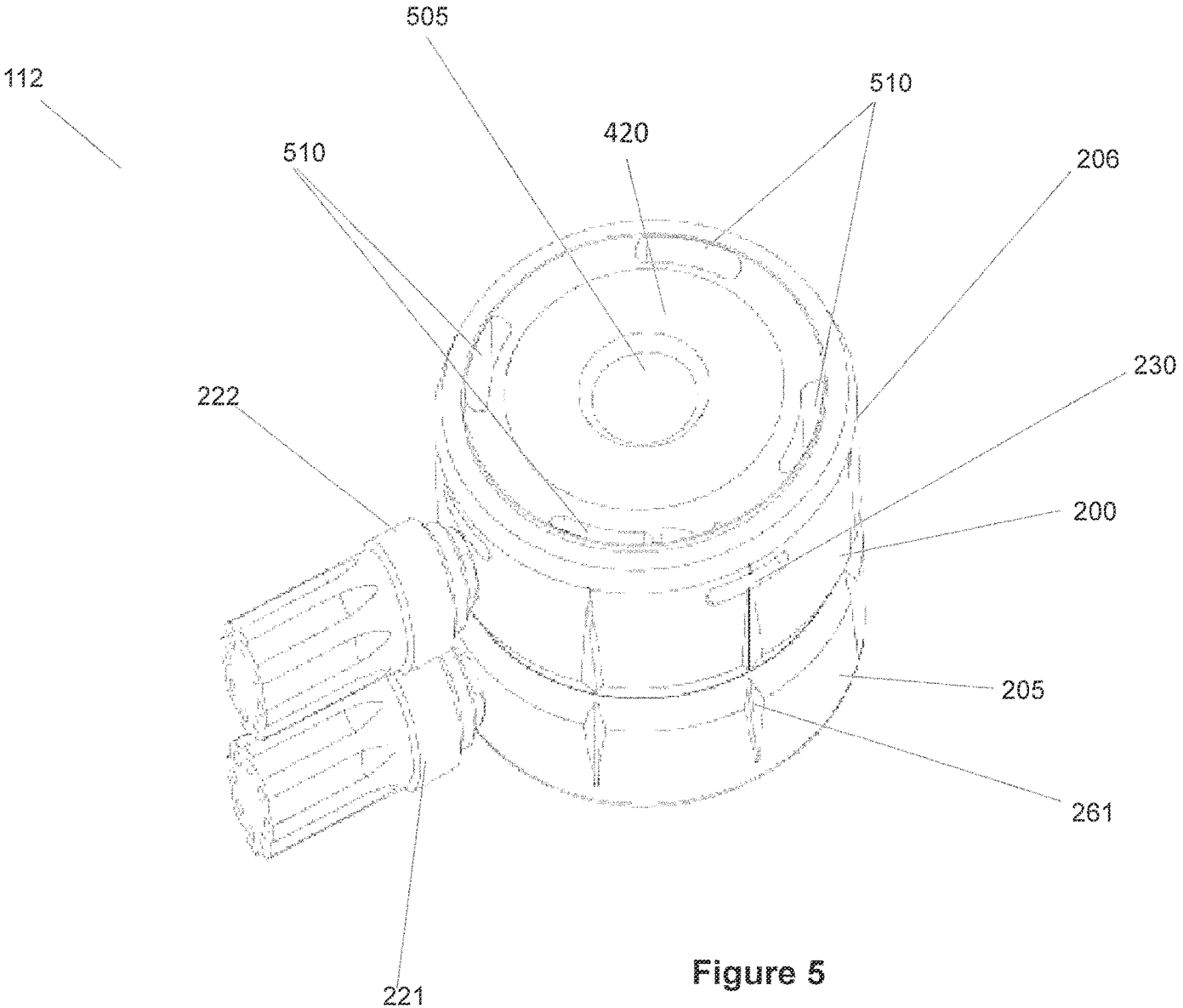
FIG. 5 is a bottom side perspective view of the heating unit in accordance with the embodiment shown in FIG. 2.
Figure 6:
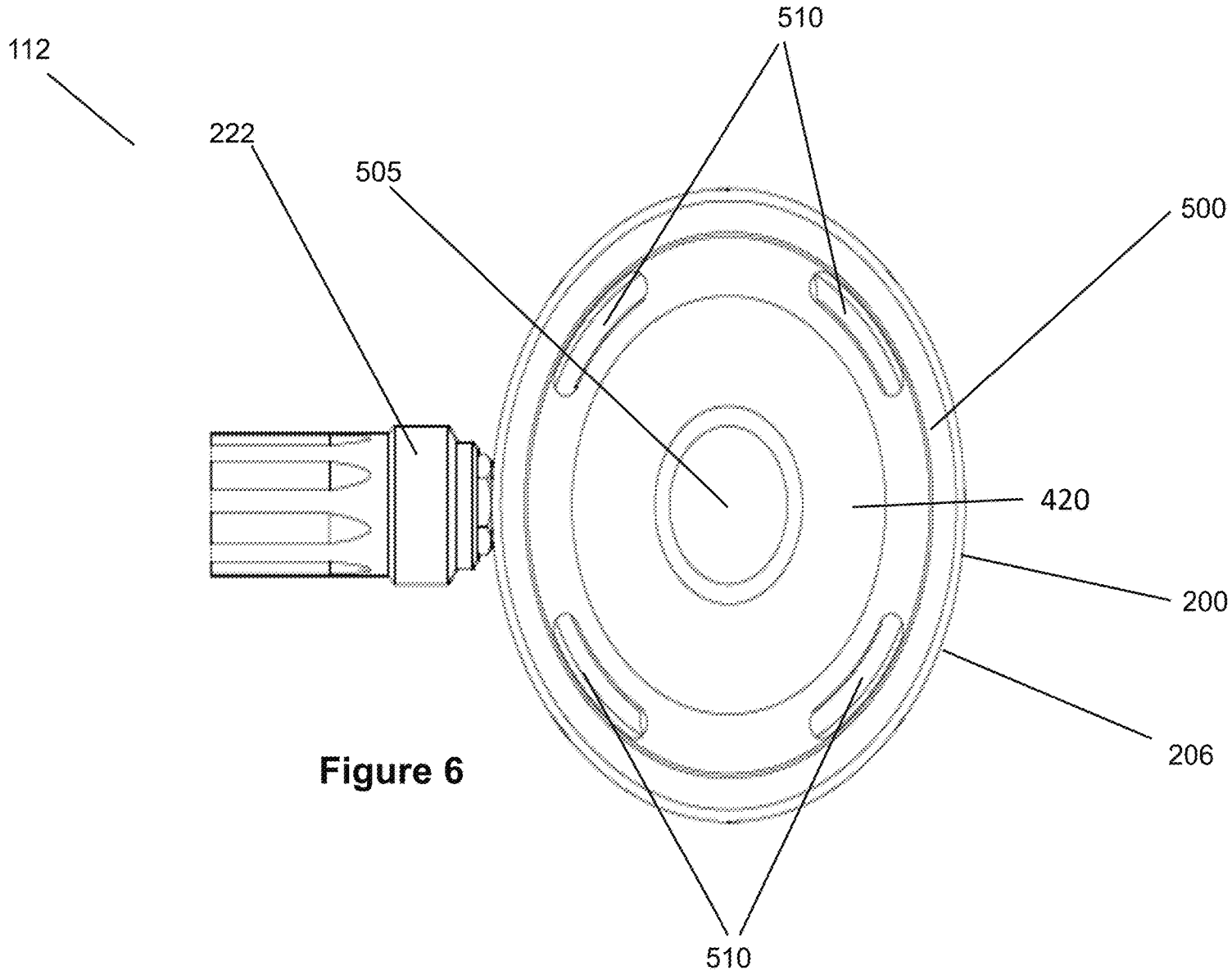
FIG. 6 is a bottom side view of the heating unit for a hookah in accordance with the embodiment shown in FIG. 2.
Figure 7:
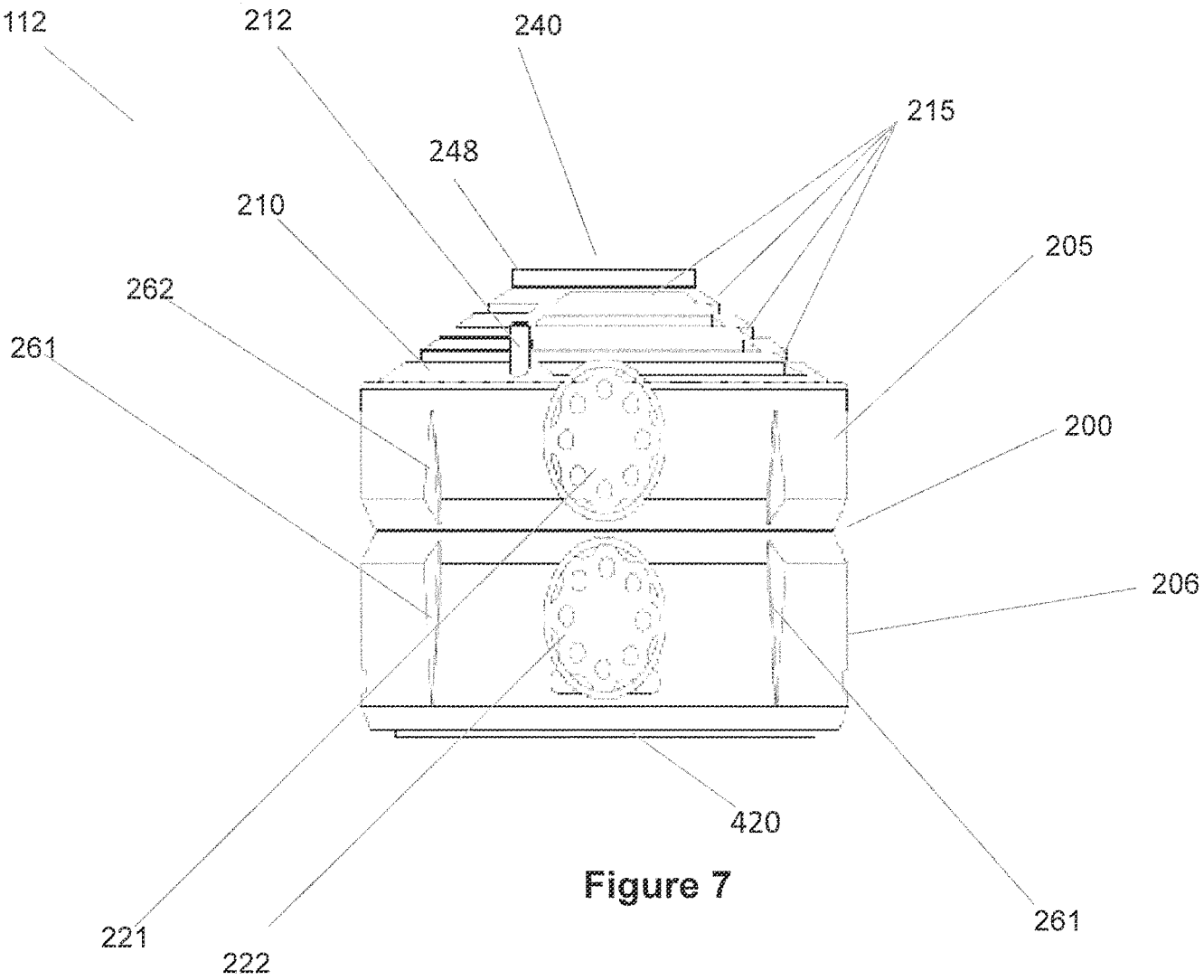
FIG. 7 is a first side view of the heating unit for a hookah in accordance with the embodiment shown in FIG. 2.
Figure 8:
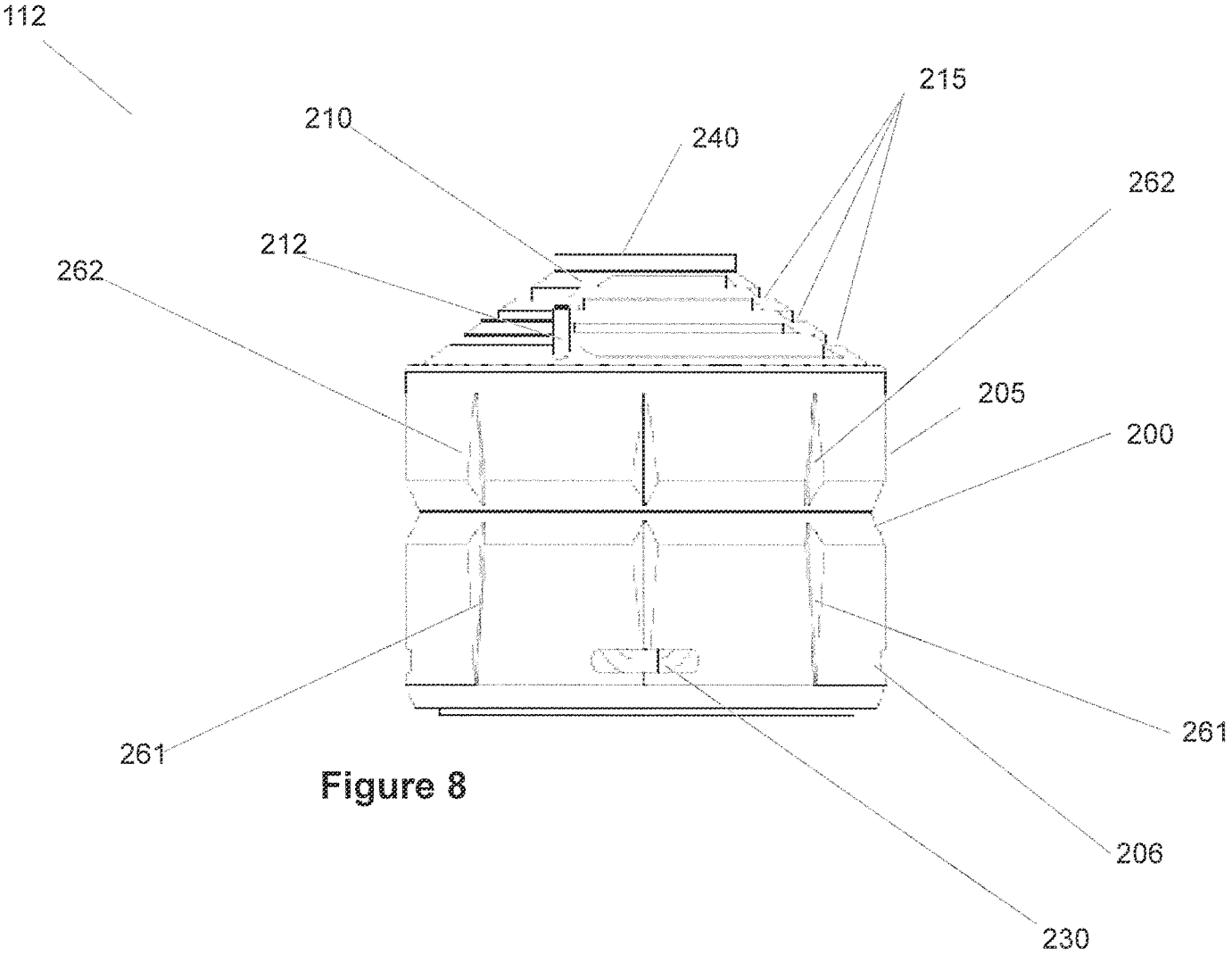
FIG. 8 is a second side view of the heating unit for a hookah in accordance with the embodiment shown in FIG. 2.
Figure 9:
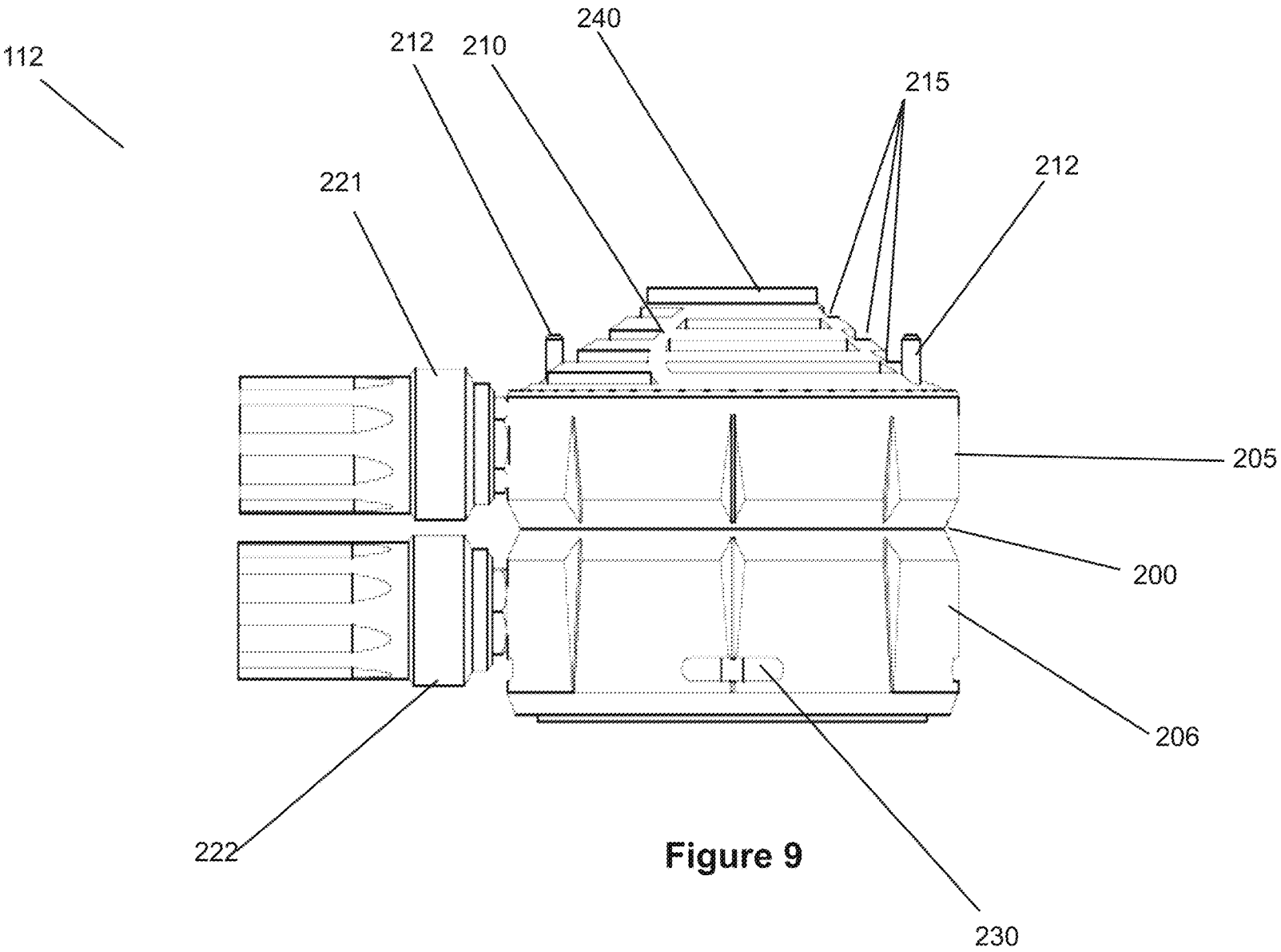
FIG. 9 is a third side view of the heating unit for a hookah in accordance with the embodiment shown in FIG. 2.
Figure 10:
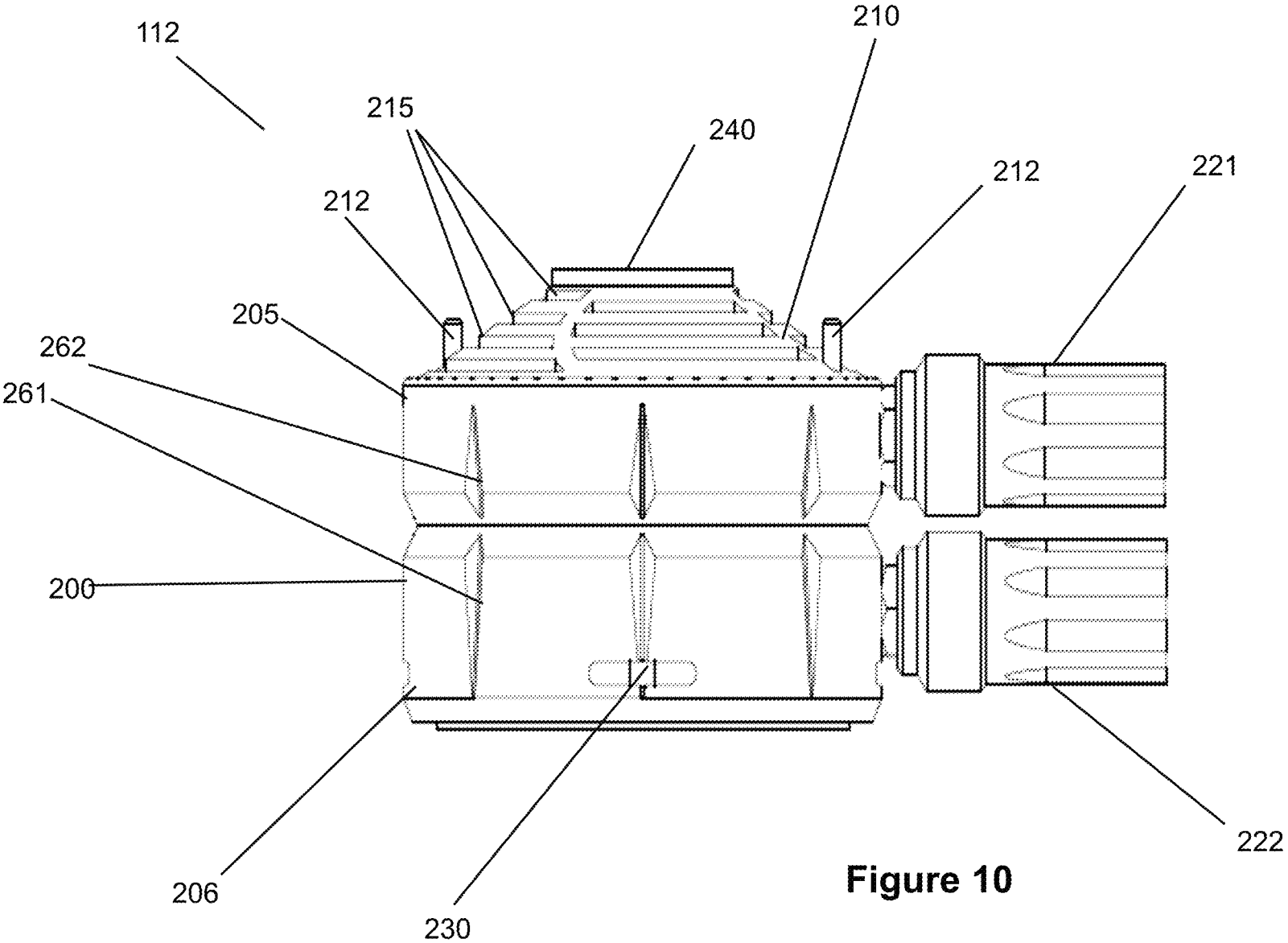
FIG. 10 is a fourth side view of the heating unit for a hookah in accordance with the embodiment shown in FIG. 2.

Top and bottom views of the housing 200 of the heating unit 112 in accordance with the shown embodiment of the invention are shown in FIGS. 4-6. In FIG. 4, cross sectional lines 10 and 11 represent the planes of cross sectional views illustrated in FIGS. 12 and 13, respectively, which are further discussed below.

FIGS. 5 and 6 show a bottom wall 420 and surface of the base 206 in a bottom view and bottom perspective view. The bottom wall 420 is shown with a coupling ring 505 so that when the housing is seated onto a structure on a hookah during installation and use, the coupling ring 505 can mate or couple to a corresponding structure or projection on the hookah for alignment purposes and/or for securement. The bottom wall 420 of the base 206 is provided with at least one thermal conduit 510. As shown, a plurality of spaced apart thermal conduits 510 are provided at the bottom wall 420 each with an opening at the bottom wall. Each of the one or more thermal conduits 510 is aligned so that its path extends through the sidewall 234 of the base 206 and terminates as an opening along a upper edge 236 of the sidewall 234, as more clearly shown in FIG. 11.

The coupling ring 505 is defined by a recess on the bottom surface of bottom wall 420 of the base 206 and can be used to guide the placement of the housing 200 onto or against a head 110 (FIG. 1) located on a hookah 100. In some embodiments, the coupling ring 505 may have an attachment mechanism such as, but not limited to, threading, a cam, bores, and/or pins that are used to affix the heating unit 212 in place in a proper orientation with respect to the head 110 of the hookah device.

The plurality of spaced apart thermal conduits 510 on the bottom wall 420 are openings or channels defined through the bottom wall 420 of the housing 210 and through the sidewall 234 of the base that are sized, shaped, and positioned to direct heat from a combustion chamber inside the housing 200 through the thermal conduits 510 at the sidewall 234 and then out the base 206 and into the cooking chamber of the head 110 (FIG. 1) located below the heating unit 112 to heat the cooking element, such as tobacco or floral essences.

In the shown embodiment, four thermal conduits 510 are incorporated proximate the perimeter edge of the bottom wall 420 of the base so as to align with the sidewall 234 of the base 206. The same thermal conduit 510 therefore has two openings, one at the bottom wall of the base and one at an end edge of the sidewall. The thermal conduits 510 can be evenly spaced apart about the bottom wall 420 and therefore also about the sidewall 234. Furthermore, the thermal conduits 510 are located on the bottom wall 420 such that they are not aligned with side air vents 230 on the sidewall 234 of the base 206 so that fresh air passing through the side air vents 230 are not immediately mixed with flow through the thermal conduits, which have hot gas coming from the combustion chamber inside the housing and then directed down through the thermal conduits 510 and into the cooking chamber inside the head.

The offset, non-aligned configurations of the thermal conduits 510 and the air vents 230 at the sidewall 234 allow for thermal mixing of hot and cold gas streams through convection to enhance the air to fuel ratio in the combustion chamber for proper heat generation. For example, fresh air can first enter through the air vents 230 to be used for burning the fuel in the combustion chamber. The heated air is then directed through the thermal conduits and out the housing for heating a cooking element, such as tobacco or floral essences.

However, in other examples, the housing 200 may have a different number of openings or vents that function as thermal conduits between the combustion chamber and the cooking chamber and can be in other than as shown locations as dictated by functionality and/or design choice in accordance with various other embodiments of the invention. For example, the thermal conduits 510 can be located radially inwardly of the sidewall 234 such that the paths of the thermal conduits are formed through the bottom wall 420 of the base 206 only, not through the sidewall. In yet other examples, there can be a combination of different thermal conduits, those that are formed through the bottom wall 420 only and those that are formed through both the bottom wall 420 of the base and through the sidewall 234 of the base.

FIGS. 7-10 show various side views of the housing 200 in accordance with the shown embodiments to better illustrate various components of the housing 200 described elsewhere herein.

FIG. 11 shows an exploded view of the shown embodiment of a heating unit. In FIG. 11, a combustion chamber 1105 within the housing 200 is shown. The combustion chamber 1105 is sized and shaped to receive a fuel source to be placed within the combustion chamber 1105 and ignited to cause the fuel to combust and generate heat. For purposes of this discussion, fuel may be wood, charcoal, coal, or any other conventional fuel source for use with a hookah. In the shown embodiment, the fuel is placed on a bottom surface 1050 of the combustion chamber 1105. In accordance with some other embodiments, the fuel may be placed on a raised platform to provide a gap between the bottom surface 1050 and the fuel for fuel/air mixing. In accordance with a few embodiments, the fuel may be placed within a defined recess and/or compartment in the combustion chamber 1105.

Also shown in FIG. 11 are handles 221 and 222, each of which comprising a shaft or rod 1111, 1112 and a gripping sheath 1113, 1114. Each shaft 1111, 1112 has a first end that is structured for insertion into a handle coupling or bore 1211, 1212 formed with the base 206 and the lid 205. The two shafts 1111, 1112 are configured to fit into the two handle bores 1211, 1212 in the housing 200 in a friction or size-on-size fit to affix to the housing 200. Optionally, the shafts 1111, 1112 can be threaded into threaded bores 1211, 1212 of the housing. Gripping sheaths 1113, 1114 can be placed over the opposite ends of the two shafts to form the handles 221, 222 shown in FIGS. 2, 6, and 12. Each gripping sheath 1113, 1114 can be made of a material that aids in the gripping of the sheath, or provided with means to facilitate gripping such as surface features or projections, and encloses at least a portion of a second end of a shaft 1111, 1112. The sheaths can be made from the same material as the housing or from a different material, such as from a silicone material or a high temperature resistant plastic, such as PEEK.

Figure 12:
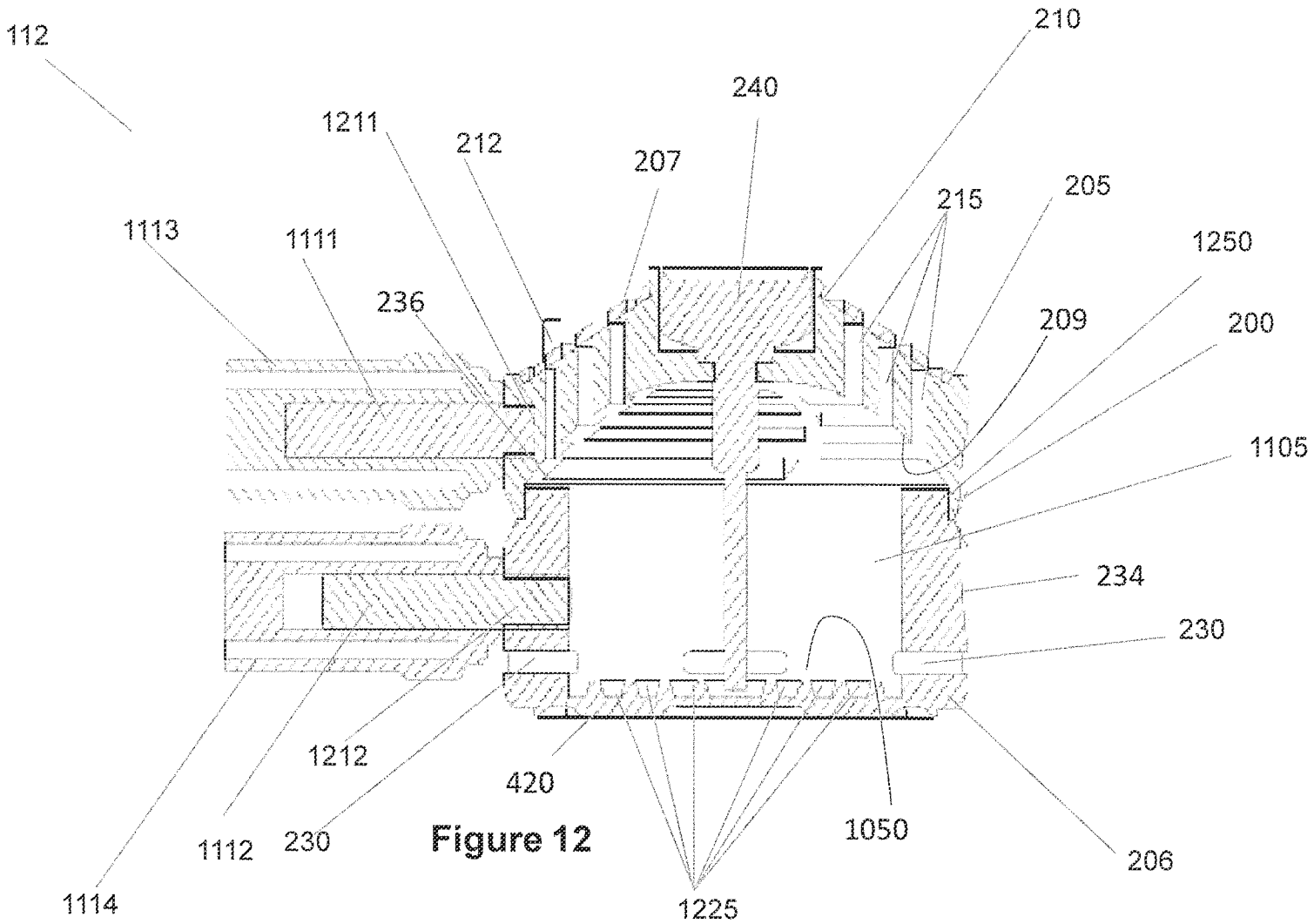
FIG. 12 is a cross sectional view along line 10 of FIG. 4 of the heating unit for a hookah in accordance with the embodiment shown in FIG. 2.

Furthermore, it can be seen in FIG. 11 that thermal conduits 510 have openings at the end edge 236 of the sidewall 234 of the base and extend through the vertical height of the sidewall 234 of the base 206 to terminate with openings at the exterior bottom surface of the bottom wall 420 of the base 206 (FIG. 6). With further reference to FIG. 12, the openings of the thermal conduits 510 at the end edge 236 of the sidewall 234 are recessed from the exterior of the sidewall of the lid 205. Further, the top wall 207 of the lid 205 has a dome shape interior surface contour 209. This dome shape interior surface contour configuration allows the end edge 236 of the sidewall 234 of the base to be exposed within the combustion chamber or not covered by the lid. In other words, when the lid is positioned over the base 206, the thermal conduits are not covered by the surface of the lid. In some examples, the outer-most bottom surface of the interior surface contour 209 of the lid, such as near the perimeter of the lid, is provided with a surface that facilitates placement of the lid over the sidewall, with little shifting or off-alignment. Thus, hot air or gas that rises to the dome shape interior surface contour 209 can be directed along the curvature of the surface to then enter through the openings of the thermal conduits 510 at the end edge 236 of the sidewall 234 to then discharge out the openings at the bottom wall of the base to flow into the cooking chamber of the hookah.

The fresh air vents 230 through the sidewall 234 located near the bottom wall 420 of the base have openings at the exterior surface of the sidewall 234 and at the interior surface of the sidewall, along a path that is generally orthogonal to the height of the sidewall. The fresh air vents 230 and the thermal conduits 510 do not have paths that connect. This allows fresh air to be directed through the air vents 230 for mixing with the fuel located inside the combustion chamber 1105 and then the heated air rises to the top dome shape interior surface contour 209 of the lid to then be directed down through the thermal conduits 510 at the end edge 236 of the sidewall 234 and then out the openings at the bottom wall 420. Where thermal conduits are incorporated through the bottom wall 420 only but not through the sidewall 234, heated air can be directed down towards the bottom wall by the top dome shape interior surface contour 209 of the lid and then through the openings at the bottom wall.

In addition, FIG. 11 shows a thermometer 240 having a substantially flat and circular display to be substantially even with a top exterior surface of the lid 205 when the thermometer is inserted into the thermometer coupling or central opening 238 at the top wall 207 of the lid 205, as shown in FIG. 12. A sensor portion of the thermometer 240, such as the thermometer stem, extends from the display into the housing for placement into the combustion chamber for sensing temperature within the combustion chamber. This allows thermometer 140 to measure the temperature inside the combustion chamber and present the measured temperature to a user at the display. The display can provide an analog reading of the temperature or a digital reading of the temperature inside the combustion chamber.

Figure 13:
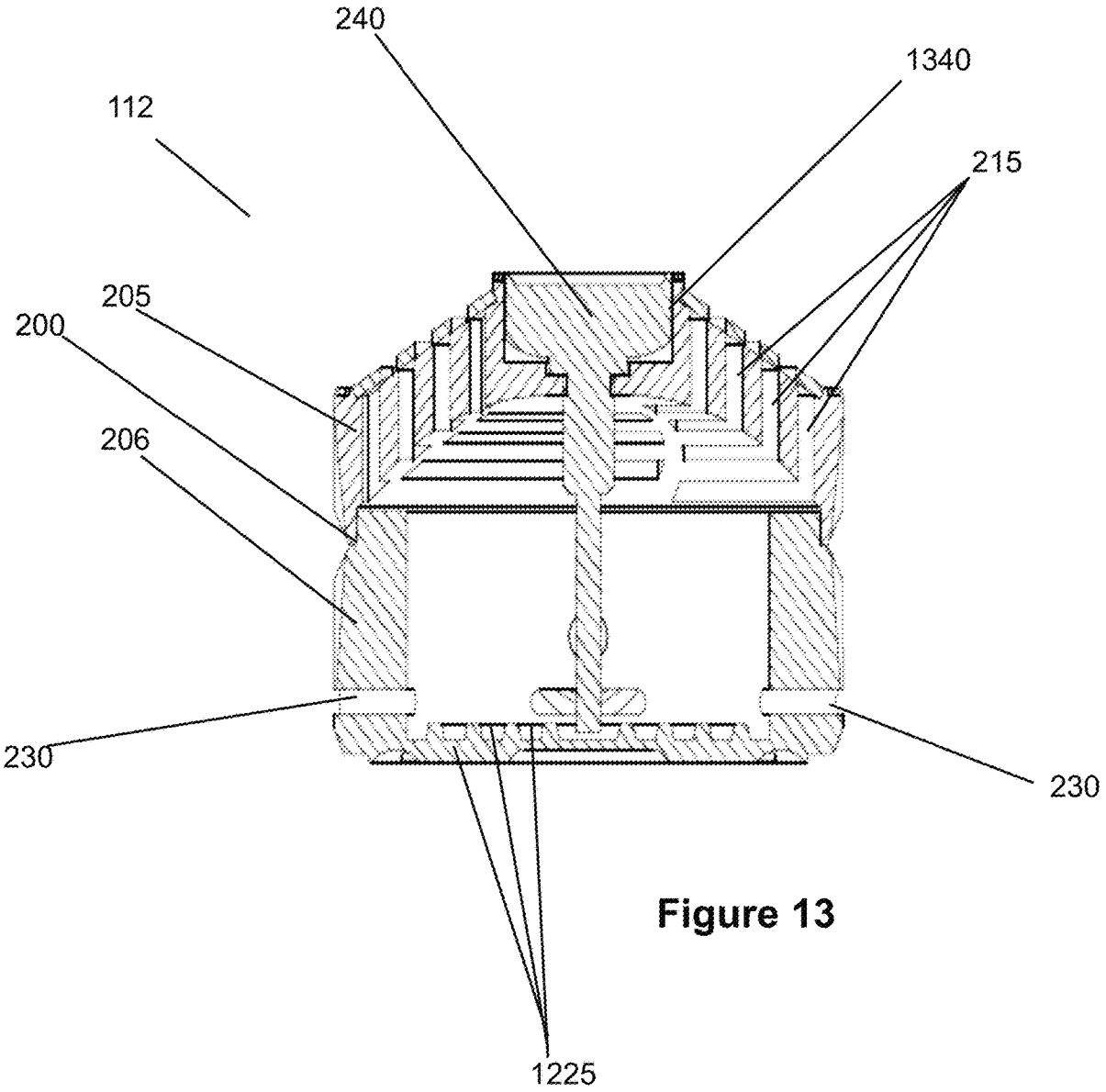
FIG. 13 is a cross sectional view along line 11 of FIG. 4 of the heating unit for a hookah in accordance with the embodiment shown in FIG. 2.

FIGS. 12 and 13 show cross sectional views taken along lines 10 and 11 of FIG. 4, respectively, of the housing 200. In FIG. 12, mated collars 1250 of the lid 205 and the base 206 are shown coupled together. In the shown embodiment, the mated collars 1250 are used to align the lid 205 and the base 206 and to secure the two when these two components are friction fit together. However, other couplings devices may be used in addition to or in lieu of the mated collars 1250. Examples of coupling devices include, but are not limited to, mated pegs and bores, mated threads, cams, latches, buckles, and hinges in accordance with various other embodiments of the invention.

Furthermore, FIG. 12 shows handle couplings 1211 and 1212 that are bores defined in the outer sidewalls 232, 234 of the lid 205 and the base 206 respectively for receiving first ends the two shafts. The shafts 1111 and 1112 of the handles 221 and 222 are friction fit into the handle couplings 1211 and 1212 in the shown embodiment. The two shafts 1111, 1112 can each incorporate a reduced tip at the respective first ends for forming shoulders on the two shafts to limit the amount of insertion into the handle coupling bores 1211, 1212. In accordance with some other embodiments, the handles and handle couplings may have threads for threaded engagement to securely couple the handles to the housing. In accordance with various other embodiments, any other type of coupling mechanism may be used to secure the handles into the handle couplings.

Ventilation grooves 1225 can be seen in FIGS. 12 and 13 located at the bottom wall 420 of the base 206. The ventilation grooves 1225 can be trenches defined in the bottom interior surface of the bottom wall 420 that allow air to flow under the fuel in the combustion chamber to facilitate combustion of the fuel, such as coal or charcoal. In the shown embodiment, the ventilation grooves 1225 are concentrically defined trenches in the bottom interior surface of the bottom wall 1050. However, the bottom interior surface may have any number of trenches that are in any configuration, including randomly placed crevices or trenches, in accordance with various other embodiments. Furthermore, ventilation at the bottom wall 1050 of the combustion chamber may be provided in other manners in accordance with some other embodiments, including, but not limited to, a raised platform with a perforated surface, a grill placed over the bottom interior surface, and a jagged surface.

A thermometer coupling 1340 can also be seen in FIGS. 12 and 13. Thermometer coupling 1340 can be an opening through a wall of the housing that has a defined recess proximate an outer surface configured to hold a top end of a thermometer while letting a sensor end of the thermometer to extend into the combustion chamber. In the shown embodiment, thermometer coupling 1340 is on a top surface of lid 205 substantially in the center of the surface and is configured to receive a thermometer having a round head that includes a display. However, heating units in accordance with some other embodiments may have thermometer coupling placed in other areas of lid 205 and/or base 206 and may be configured to receive different types of thermometers.

Methods of making hookah devices and components thereof and methods of using the disclosed hookah devices and components thereof, including of heating units, are within the scope of the present invention.

Although various embodiments of hookah devices and components thereof, such as embodiments of heating units are described above, other hookahs that add, alter, combine and/or remove components are possible in accordance with various other embodiments of the invention. Furthermore, although the invention has been discussed with respect to various embodiments, it should be recognized that the invention comprises the novel and non-obvious claims supported by this disclosure.

What is claimed is:

1. A heating unit for use with a hookah device comprising:

a two part housing comprising a base and a lid;

said base comprising a bottom wall and a base sidewall extending upwardly from the bottom wall and having an exterior surface, an interior surface, and an upper edge between the exterior surface and the interior surface, and wherein the base sidewall has a thickness measured between the exterior surface and the interior surface;

said lid comprising a top wall and a lid sidewall extending downwardly from the top wall;

said base sidewall and said lid sidewall having a seam therebetween;

a combustion chamber defined by the top wall, the bottom wall, the base sidewall, and the lid sidewall;

two or more spaced apart fresh air vents formed through the exterior surface and the interior surface of the base sidewall below the upper edge with each of the two or more spaced apart fresh air vents being located at a radial position relative to a central part of the bottom wall; and two or more spaced apart thermal conduits formed through the thickness of the base sidewall with each thermal conduit having an opening at the upper edge of the base sidewall and an opening at an exterior of the bottom wall.

2. The heating unit of claim 1, wherein said radial positions of the two or more spaced apart thermal conduits and said two or more spaced apart fresh air vents are at different radial positions relative to the central part.

3. The heating unit of claim 1, further comprising a vent cover placed on top of the top wall and rotatable relative to the top wall.

4. The heating unit of claim 2, wherein the top wall of the lid has a dome shape interior surface contour.

5. The heating unit of claim 1, further comprising an opening formed through the top wall of the lid having a thermometer located therein.

6. The heating unit of claim 1, wherein the base is located above a water bowl of a hookah device having a downstem located in the interior of the base.

7. The heating unit of claim 6, further comprising a hose port and a purge port projecting outwardly of an opening of the water bowl of the hookah device.

8. The heating unit of claim 6, wherein a catch tray is located between the base and the water bowl.

9. The heating unit of claim 6, further comprising a head section with a cooking chamber located between the base and the water bowl.

10. The heating unit of claim 3, wherein the top wall of the lid comprises a plurality of spaced apart top vents.

11. The heating unit of claim 10, wherein the vent cover comprises a plurality of spaced apart top vents.

12. The heating unit of claim 11, wherein the top vents of the vent cover align with the top vents of the top wall in a first position of the vent cover and out of alignment when in a second position of the vent cover.

13. The heating unit of claim 1, further comprising a removable handle extending the base sidewall of the base.

14. The heating unit of claim 13, further comprising a removable handle extending from the lid sidewall of the lid, and wherein the two removable handles point generally in a same direction.

15. A heating unit for use with a hookah device comprising:

a two part housing comprising a lid located on top of a base and a seam is located between the lid and the basethere;

said lid comprising a top wall comprising a plurality of vents and a lid sidewall extending downwardly from the top wall, wherein the top wall at least partially covering a space defined by the lid sidewall;

said base comprising a bottom wall and a base sidewall, said base sidewall having a height. a thickness defined between an exterior surface and an interior surface, a top edge between the interior surface and the exterior surface, and a plurality of vents formed through the exterior surface and the interior surface below the top edge;

a combustion chamber defined by the top wall, the bottom wall, the base sidewall, and the lid sidewall;

a vent cover positioned atop the top wall of the lid, said vent cover being rotatable relative to the top wall to act as louvers to expose or cover the plurality of vents on the top wall.

16. The heating unit of claim 15, wherein said vent cover comprises a plurality of top vents that align with the plurality of vents on the top cover when the vent cover is in a first position and that are not aligned when the vent cover is in a second position.

17. The heating unit of claim 15, further comprising a plurality of thermal conduits formed through the base sidewall and each thermal conduit comprising an opening at the top edge of the base sidewall.

18. A heating unit for use with a hookah device comprising:

a two part housing comprising a lid mounted on top of a base and having a seam therebetween;

said base comprising a bottom wall and a base sidewall and said lid comprising a top wall and a lid sidewall, wherein the lid sidewall is positioned atop and contacts the base sidewall;

a combustion chamber defined by the top wall, the bottom wall, the base sidewall, and the lid sidewall;

a vent cover located on top of the top wall and movable relative to the top wall to control opening sizes of top vents of the top wall for regulating gas flow; and a removable handle extending radially from the base sidewall, said handle being removably threaded to the base sidewall.

19. The heating unit of claim 18, further comprising a handle extending radially from the lid sidewall and being removable from the lid sidewall, and wherein the removable handle on the lid sidewall and the removable handle on the base sidewall are generally aligned and each has a generally cylindrical configuration.

20. The heating unit of claim 18, wherein said base sidewall has a height, a thickness defined between an exterior surface and an interior surface of the base sidewall, a top edge located between the exterior surface and the interior surface, and a plurality of vents formed between the exterior surface and the interior surface of the base sidewall and each comprising an opening at the top edge.

* * * * *